US011788360B2

(12) United States Patent
MacKay

(10) Patent No.: US 11,788,360 B2
(45) Date of Patent: Oct. 17, 2023

(54) WELLBORE REAMER

(71) Applicant: Engineering Innovation & Design Limited, Aberdeen (GB)

(72) Inventor: Alexander Craig MacKay, Aberdeen (GB)

(73) Assignee: ENGINEERING INNOVATION & DESIGN LIMITED, Aberdeen (GB)

( * ) Notice: Subject to any disclaimer, the term of this patent is extended or adjusted under 35 U.S.C. 154(b) by 236 days.

(21) Appl. No.: 17/051,674

(22) PCT Filed: Apr. 29, 2019

(86) PCT No.: PCT/GB2019/051183
§ 371 (c)(1),
(2) Date: Oct. 29, 2020

(87) PCT Pub. No.: WO2019/211588
PCT Pub. Date: Nov. 7, 2019

(65) Prior Publication Data

US 2021/0189803 A1 Jun. 24, 2021

(30) Foreign Application Priority Data

Apr. 30, 2018 (GB) ..... 1807021

(51) Int. Cl.
*E21B 10/30* (2006.01)
*E21B 10/22* (2006.01)

(52) U.S. Cl.
CPC ..... *E21B 10/30* (2013.01); *E21B 10/22* (2013.01)

(58) Field of Classification Search
CPC ..... E21B 10/30; E21B 10/083; E21B 10/22
See application file for complete search history.

(56) References Cited

U.S. PATENT DOCUMENTS 1,772,491 A 8/1930 Koppl
1,805,087 A * 5/1931 Hamer ..... E21B 10/003 175/401

(Continued)

FOREIGN PATENT DOCUMENTS

SU 632 822 A1 11/1978
WO 2014/138844 A1 9/2014

(Continued)

OTHER PUBLICATIONS

International Search Report and Written Opinion for International Patent Application No. PCT/GB2019/051183 dated Sep. 13, 2019, 21 pages.

(Continued)

*Primary Examiner* — Cathleen R Hutchins
(74) *Attorney, Agent, or Firm* — Klintworth & Rozenblat IP LLC

(57) ABSTRACT

A wellbore roller-reamer comprises a mandrel rotatable about a mandrel axis, and a first roller mounted around the mandrel and having an outer reaming surface for engaging a wall of a wellbore. The first roller is rotatable relative to the mandrel about a first roller axis which is offset from the mandrel axis such that, during use, rotation of the mandrel with the outer reaming surface engaged with a wall of the wellbore causes the first roller to be driven to rotate relative to the mandrel and ream the wall of the wellbore.

17 Claims, 14 Drawing Sheets

(56) References Cited

U.S. PATENT DOCUMENTS

| | | | |
|---|---|---|---|
| 3,400,773 | A | 9/1968 | Tiraspolsky et al. |
| 3,982,594 | A | 9/1976 | Berthiaume |
| 4,082,373 | A | 4/1978 | Kellner |
| 4,102,552 | A | 7/1978 | Kellner |
| 8,381,843 | B1 | 2/2013 | Lamontagne |
| 2014/0158432 | A1 | 6/2014 | Simpson |

FOREIGN PATENT DOCUMENTS

| | | | |
|---|---|---|---|
| WO | 2015/199973 | A1 | 12/2015 |
| WO | 2019/075076 | A1 | 4/2019 |

OTHER PUBLICATIONS

European Exam Report dated Aug. 13, 2021 for European Application No. 19721372.1, 4 pages.
European Exam Report dated Feb. 7, 2023 for European Application No. 19721372.1, 5 pages.

* cited by examiner

WELLBORE REAMER

FIELD

The present disclosure relates to a wellbore reamer, more particularly to a wellbore roller reamer.

BACKGROUND

Wellbores, for example associated with the exploration and production of hydrocarbons, are drilled through layers of rock laid-down by successive geological processes which formed different rock types with different physical and chemical properties such as clay, sandstone, limestone, chalk, shale, conglomerates, etc. After the rocks have formed, further geological processes, such as plate tectonics, have caused shifts in the rock strata which has inclined them at angles and induced faults which may then mineralise causing 'stringers' within the strata.

As the well-bore is drilled through this chaotic mixture of rock formations the drill-bit may not follow a completely smooth path and small ledges and bends or dog-legs will be formed and, after the drill has passed, sections of the formation may protrude into the new-formed bore, creating bore restrictions. There are many mechanisms or phenomena which can cause such restrictions, such as formation slippage, bore sagging, swelling of the formation and the like. Further, wear of the drill bit may cause a reduction in the gauge diameter of the wellbore over time.

Such bore restrictions, reduced bore gauge and the like can create sticking points where full-bore tools or larger tubulars such as casings and liners may hang-up in the well causing problems and increasing the difficulty and time required to drill and complete the well.

In an effort to address such issues tools are placed in the Bottom Hole Assembly (BHA) which follow the path of the drill bit and ream-out these restrictions to either remove them or reduce their severity. This is currently performed by either solid-state reaming tools or with so called roller-reamers.

An example known roller-reamer tool 10 is diagrammatically illustrated in FIGS. 1 and 2, in use during the drilling of a bore 12, wherein FIG. 2 is a cross-section on line 2-2 of FIG. 1. The roller-reamer tool 10 is mounted on a drill string 14 above a drill bit 16, and includes a number of rollers 18 circumferentially arranged at the same axial location around a reamer body, wherein the rollers 18 run on bearings on a shaft 20. Rotation of the drill string 14 causes the rollers 18 to orbit the bore 12, with engagement with the surface of the bore 12 causing the rollers 18 to rotate on their respective shafts 20 and provide the desired reaming action. An example of such a roller reamer is disclosed in U.S. Pat. No. 1,660,309.

In such known roller-reamers the rollers have to be small in relation to the diameter of the tool. As the tool rotates in the bore, the rollers are driven around the well bore at higher speed as they must rotate several times to cover the bore diameter. The shafts through the rollers are therefore smaller again which severely restricts the size of the bearings which can be placed on them. These bearings have to cope with high loads and high rotary speeds and the placement of the rollers also means there is restricted capacity to provide grease reservoirs to maintain lubrication during operation. The tools become limited by the number of thousand revolutions or K.rev's they can survive. Looking at the trend in current drilling practices, the rotary speeds are increasing and the existing roller-reamers start to struggle to cope with the increased demands placed on them.

There is also a reluctance to use roller-reamers in high cost drilling operations due to the possibility of the smaller shafts and bearings wearing through and rollers being lost in the hole causing significant delays and associated cost in 'fishing' operations to remove the debris from the hole.

SUMMARY

An aspect of the present disclosure relates to a wellbore roller-reamer, comprising:

a mandrel rotatable about a mandrel axis;

a first roller mounted around the mandrel and having an outer reaming surface for engaging a wall of a wellbore, the first roller being rotatable relative to the mandrel about a first roller axis which is offset from the mandrel axis such that, during use, rotation of the mandrel with the outer reaming surface engaged with a wall of the wellbore causes the first roller to be driven to rotate relative to the mandrel and ream the wall of the wellbore.

By mounting the first roller around the mandrel the first roller may be permitted to define a larger diameter than known roller-reamers. This may mitigate issues associated with known smaller dimeter rollers. In some examples the first roller may define an outer diameter which is more comparable with the diameter of the wellbore. This may facilitate a slower rotation of the first roller. For example, where the first roller may define an outer diameter which is 80% of the bore diameter, the first roller may rotate at approximately 115% of the rotational speed of the mandrel. This contrasts significantly with known roller reamers, such as exemplified in FIGS. 1 and 2. In such a known roller reamer an individual roller may define an outer diameter which is 35% of the bore diameter, which would result in the smaller rollers rotating at approximately 300% of the rotational speed of the mandrel.

Furthermore, by mounting the first roller around the mandrel, larger bearing surfaces may be permitted, which may provide improvements over prior art reamers. Such larger bearing surfaces may provide more robust rotational support, which may contribute to longevity and reliability. Furthermore, such larger bearing surfaces may accommodate improved capacity to incorporate and deliver lubrication to the bearing surfaces.

The offset between the mandrel and the first roller axes may permit or facilitate the first roller to be driven to rotate when in use, thus effecting reaming of the wellbore. Such rotation of the first roller by rotation of the mandrel may thus eliminate any requirement to provide a separate roller drive.

The relative rotation between the mandrel and the first roller during use may be relative counter-rotation. That is, when the mandrel is driven to rotate in a first rotational direction, the first roller is driven, by rotation of the mandrel and engagement with the bore wall, to rotate in a reverse second rotational direction.

The offset of the mandrel axis and the first roller axis may comprise a lateral offset. The offset may be such that the first roller is eccentrically mounted relative to the mandrel. In such an arrangement the lateral offset of the mandrel axis and the first roller axis may be such that during rotation of the mandrel the first roller axis effectively orbits the mandrel axis. This, combined with engagement of the reaming surface of the first roller with the bore wall may facilitate the first roller being rotatably driven, for example in counter rotation.

The eccentric mounting of the first roller, and thus the eccentric contact point achieved with a bore wall, may effectively define a larger overall effective tool diameter.

The mandrel and first roller axes may be parallel with each other.

In some examples the outer reaming surface may extend continuously around the circumference or outer periphery of the first roller. However, in other examples the outer reaming surface may extend discontinuously around the circumference or outer periphery of the first roller. Such a discontinuous outer reaming surface may facilitate improved bypass of fluids and/or debris past the first roller during use.

The first roller may comprise at least one bypass recess which extends axially along the outer surface of the first roller. The at least one bypass recess may be defined by one or more regions of relief relative to the outer reaming surface of the first roller.

When the wellbore roller-reamer is in use, the at least one bypass recess may assist to improve bypass of fluid and/or debris past the first roller. In this respect, and as noted above, by mounting the first roller around the mandrel the first roller may be permitted to define a larger diameter than known roller-reamers. As a consequence, however, when the wellbore roller-reamer is in use the first roller may occupy a substantial section of the bore, such that fluid bypass around the first roller may be restricted. The provision of the at least one bypass recess may address this possible restriction issue by providing a larger flow area past the first roller.

By improving bypass past the first roller flow restriction may be minimised, thus in turn minimising adverse pressure differentials across the reamer. Further, the improved bypass by the presence of the at least one bypass recess may minimise a restriction point which may otherwise cause possible difficulty in passing rock-cuttings back up the well, for example in the context of wellbore drilling, with a drilling bottom hole assembly (BHA) located below or ahead of the wellbore roller-reamer (i.e., the wellbore roller-reamer used in a drill string uphole of a drill bit). Should the rock cuttings accumulate in said restrictions this would not only impair the efficiency of the drilling process, but would also restrict the ease of pulling the BHA out of the well.

The at least one bypass recess may be defined by one or more of grooves, slots, channels, flutings and/or the like.

The at least one bypass recess may be aligned axially along the length of the first roller. Alternatively, or additionally, the at least one bypass recess may be arranged helically along the length of the first roller. Such a helical path may allow the projected circumference of the outer reaming surface of the roller to create full 360 degree coverage. Alternatively, the helical path may permit partial circumferential coverage of the outer reaming surface (e.g. 270 degree coverage).

A 360 degree coverage may permit operation of the wellbore reamer tool to be more efficient and the tool less susceptible to wash-out sections. Partial coverage (e.g. 270 degree coverage) profiles may allow for more freedom of movement of drilling fluids and rock debris.

The presence of the at least one bypass recess may be such that the outer reaming surface extends discontinuously around the circumference or outer periphery of the first roller.

In some examples a plurality of bypass recesses may be provided in the outer surface of the first roller. The first roller may comprise a plurality of circumferentially arranged discrete portions of the outer reaming surface separated by respective bypass recesses.

In one example the first roller may comprise a plurality of rib structures extending outwardly (e.g., radially) of the first roller, wherein each rib structure defines a discrete portion of the outer reaming surface of the first roller. The rib structures may be separated by respective bypass recesses. The rib structures may be aligned axially along the length of the first roller. Alternatively, or additionally, the rib structures may be arranged helically along the length of the first roller.

The outer reaming surface of the first roller (or discrete portions thereof which may be provided on rib structures, as noted above) may define a suitable geometry or composition to provide efficient wellbore reaming. The outer reaming surface may comprise at least one, and in some examples a plurality of inserts to provide a reaming structure. The inserts may comprise any suitable hard material such as tungsten carbide, diamond impregnated matrix, hardened steel or the like. The inserts may be one or more of brazed, sprayed/welded or otherwise deposited onto the outer reaming surface.

As noted above, the first roller is mounted around the mandrel. As such, the first roller circumscribes the mandrel. The first roller may in this case be of a generally ring form, sleeve form or the like.

The mandrel may comprise or define a mounting surface for supporting the first roller. In some examples the mounting surface may be concentric with the mandrel axis. Alternatively, the mounting surface may be eccentrically formed relative to the mandrel axis. Such eccentricity of the mounting surface may provide or contribute to the lateral offset of the first roller axis.

The mandrel may comprise two axial sections with different outer dimensions (e.g., diameters). In this example the mounting surface may be provided on a section of the mandrel with a reduced outer dimension (e.g., diameter). The mandrel may define a stepped profile. The mandrel may comprise a transition region or profile between the two axial sections with different outer dimensions. The transition region may comprise a stepped profile. The transition region may be suitably configured for the purposes of stress management. For example, the transition region may comprise a curved or radiused geometry.

In some examples the mandrel may define an axial shoulder adjacent the mounting surface. The first roller may be mounted adjacent the axial shoulder. The axial shoulder may function to position the first roller on the mandrel. The wellbore roller-reamer may comprise a spacer element, such as a spacer ring axially posited between the axial shoulder and the first roller.

The first roller may be indirectly mounted on the mandrel. The wellbore roller-reamer may comprise a first bearing sleeve which is mounted on the mandrel (e.g., on the mounting surface of the mandrel), wherein the first roller is mounted on the first bearing sleeve. The first roller and the first bearing sleeve may define at least part of a first roller assembly which is mounted on the mandrel. In some examples the first roller assembly may be configured to be assembled prior to mounting or installing on the mandrel. Alternatively, the first roller assembly may be at least partially assembled on the mandrel.

The first bearing sleeve may be circumferentially continuous. Alternatively, the first bearing sleeve may be circumferentially discontinuous, for example provided in two or more circumferential segments which are assembled together to define the complete first bearing sleeve. In one example the first roller, once mounted on the assembled first bearing sleeve, may assist to hold the circumferential segments together.

The first bearing sleeve may be rotatably secured to the mandrel, whereas the first roller may be rotatably mounted on the first bearing sleeve. This may permit the first roller to be rotatable relative to the mandrel. The first bearing sleeve may be rotatably secured to the mandrel via a rotary connection therebetween. Any suitable rotary connection may be provided, for example, keys, keyways, splines, dogs, screws, non-round complimentary profiles between the mandrel and the first bearing sleeve, and/or the like.

The first bearing sleeve may be concentric with the mandrel axis. Alternatively, the first bearing sleeve may be eccentric relative to the mandrel axis. Such eccentricity of the first bearing sleeve may provide or contribute to the lateral offset of the first roller axis.

The bearing sleeve may define a varying circumferential wall thickness to facilitate the first roller being mounted and arranged in such a way that the first roller axis is offset form the mandrel axis. In one example the first bearing sleeve may define an inner cylindrical surface and an outer cylindrical surface, wherein the inner and outer cylindrical surfaces are eccentrically arranged. Such eccentric alignment of the inner and outer surfaces may permit the first roller axis to be offset form the mandrel axis.

The first bearing sleeve may define a bearing surface, to facilitate relative rotation between the first bearing sleeve and the first roller. The first bearing sleeve may define a plain bearing, friction bearing or the like. In some examples the bearing surface may be circumferentially continuous. Alternatively, the bearing surface may be defined by at least one, and in some examples a plurality of discrete bearing surfaces. Each discrete bearing surface may define a portion of a cylindrical surface.

In some examples the wellbore roller-reamer may comprise at least one bearing element interposed between the first roller and the first bearing sleeve. The at least one bearing element may form part of the first roller assembly. The at least one bearing element may comprise a friction bearing element. The at least one bearing element may comprise a low-friction material. The at least one bearing element may comprise at least one bearing pad. The at least one bearing element/pad may extend at least one of axially, circumferentially and spirally relative to one or both of the mandrel and first roller axes.

A plurality of bearing elements may be provided. In some examples the plurality of bearing elements may be at least one of circumferentially and axially distributed relative to each other.

One or more of the at least one bearing elements may be integrally formed with one of the first roller and the first bearing sleeve. One or more of the at least one bearing elements may be separately formed and subsequently mounted between the first roller and the first bearing sleeve. One or more of the at least one bearing element may be replaceable, which may facilitate suitable redressing of the wellbore roller-reamer.

The first bearing sleeve may define at least one pocket configured to receive at least one bearing element. The roller may define at least one pocket configured to receive at least one bearing element. In examples where a first bearing sleeve and discrete bearing elements/pads are provided, the first bearing sleeve and elements/pads may collectively define a bearing sub assembly.

In some examples one or more of the at least one bearing elements may be arranged to provide or contribute to providing the lateral offset of the first roller axis. In one example one or more of the at least one bearing elements may comprise or define a varying outer dimension. For example, a single bearing element may define a varying outer dimension. Alternatively, or additionally, first and second bearing elements which are circumferentially separated may extend to different radial extents relative to the mandrel axis.

The wellbore roller-reamer may comprise a seal arrangement between the first roller and the first bearing sleeve. The seal arrangement may comprise one or more O-rings or the like. The seal arrangement may comprise or form part of a first roller assembly.

The first roller may be directly mounted on the mandrel, for example directly mounted on the mounting surface of the mandrel. That is, a separate bearing sleeve may be omitted. In such an example the mounting surface may define a bearing surface. The mounting surface may be circular in form to permit the first roller to be rotatably mounted thereon. The mounting surface may be eccentric relative to the mandrel axis, to permit the roller axis to be laterally offset form the mandrel axis.

In examples where the first roller is rotatably mounted directly on the mandrel, at least one bearing element, for example as described above, may be provided between the mandrel and the first roller.

The wellbore roller-reamer may comprise a plurality of rollers arranged axially along the mandrel. Two or more of the plurality of rollers may be offset form each other.

The wellbore roller-reamer may comprise a second roller mounted around the mandrel, wherein the second roller comprises an outer reaming surface. The second roller may be rotatable relative to the mandrel about a second roller axis which is offset, for example laterally offset, from the mandrel axis such that, during use, rotation of the mandrel with the outer reaming surface engaged with a wall of the wellbore causes the second roller to be driven to rotate relative to the mandrel and ream the wall of the wellbore. The offset of the second roller axis may be such that the second roller is considered to be eccentrically mounted on the mandrel.

The second roller axis may also be offset, for example laterally offset, from the first roller axis. Such an arrangement may be such that the eccentricity of the first and second roller may be provided in different radial directions relative to the mandrel.

The combination of eccentric mounting of the first and second rollers, and thus the provision of eccentric contact points with the bore wall may define a larger overall effective tool outer diameter.

The first and second rollers may be axially distributed on the mandrel. The first and second rollers may be provided adjacent each other. In some examples the wellbore roller-reamer may comprise a thrust ring or similar structure axially interposed between the first and second rollers. Such a thrust ring may be provided as part of a roller assembly.

The second roller may be configured similarly or identical to the first roller, and as such the features defined herein with respect to the first roller may be considered to also be the case for the second roller. For example, both the first and second rollers may comprise respective bearing sleeves, and thus be provided as part of respective first and second roller assemblies. In this respect, the wellbore roller-reamer may comprise first and second roller assemblies mounted on the mandrel.

The wellbore roller-reamer may comprise a third roller mounted around the mandrel, wherein the third roller comprises an outer reaming surface. The third roller may be rotatable relative to the mandrel about a third roller axis which is offset, for example laterally offset, from the mandrel axis such that, during use, rotation of the mandrel with the outer reaming surface engaged with a wall of the wellbore causes the third roller to be driven to rotate relative to the mandrel and ream the wall of the wellbore. The offset of the third roller axis may be such that the third roller is considered to be eccentrically mounted on the mandrel.

The third roller axis may also be offset, for example laterally offset, from the first and/or second roller axes. Such an arrangement may be such that the eccentricity of the first, second and/or third rollers may be provided in different radial directions relative to the mandrel. In one example, the first, second and third roller axes may be evenly distributed around the mandrel axis, for example at a 120 degree phasing.

The combination of eccentric mounting of the first, second and third rollers, and thus the provision of eccentric contact points with the bore wall may define a larger overall effective tool outer diameter.

The first, second and third rollers may be axially distributed on the mandrel (e.g., axially stacked on the mandrel). The second and third rollers may be provided adjacent each other. In some examples the wellbore roller-reamer may comprise a thrust ring or similar structure axially interposed between the second and third rollers. Such a thrust ring may be provided as part of a roller assembly.

The third roller may be configured similarly or identical to the first and/or second roller. The third roller may form part of a roller assembly.

The wellbore roller-reamer may comprise any number of rollers. The rollers may be employed with a suitable configuration such that a defined distribution of the respective contact points with the bore wall is provided. The distribution may include a unique angular position for each contact point. A repeating pattern of contact points may be established, for example six contact points distributed evenly at 60 degrees relative to each other (e.g., at positions 1, 2, 3, 4, 5, 6 at 60 degree spacing), or six contact points at positions with 120 degree spacing (e.g., at positions 1, 2, 3, 1, 2, 3 at 120 degree spacing).

The provision of multiple axially distributed rollers with offset roller axes which are distributed around the mandrel axis may establish a preferential distribution (i.e., axial and circumferential) of contact points between the respective reamer surfaces and the wall of a wellbore. This may provide improved wellbore reaming. Further, such an axial and circumferential distribution of reaming contact points may provide a stabilising function of the wellbore roller-reamer during use, which may provide benefits to an associated drilling BHA. In this respect the wellbore roller-reamer may be used as a component of a drill string, wherein the wellbore roller reamer is disposed uphole of the drill bit on the drill string assembly.

The wellbore roller-reamer may comprise a lubricant system for providing a lubricant to the first roller, and/or additional rollers when present. The lubricant system may function to provide a lubricant to the first roller and/or additional rollers during use. Any suitable lubricant may be provided which can provide a lubricant effect in the intended wellbore environment. The lubricant may comprise, for example, grease, oil or the like.

The lubricant system may comprise a lubricant reservoir. A lubricant circuit may be defined to permit delivery of lubricant from the lubricant reservoir to the first and/or additional rollers when present. The lubricant circuit may comprise one or more of a conduit, channel, recess, groove, annulus, capillary conduit and/or the like. In some examples the lubricant circuit may be at least partially provided by profiled features incorporated into different components of the wellbore roller-reamer, such as in the outer surface of the mandrel, in ports extending through the bearing sleeve, via annular channels and the like.

The lubricant reservoir may be axially positioned relative to the first roller (and optionally any additional rollers when present.

The lubricant system may comprise a reservoir sleeve mounted around the mandrel to define a radial space between the mandrel and the reservoir sleeve, wherein the radial space is configured to contain a lubricant. The reservoir sleeve may be axially adjacent a roller mounted on the mandrel, for example the first roller, or alternatively further rollers (e.g., second, third etc.) if present. As such, the reservoir sleeve may be axially stacked with the first and any additional rollers. The wellbore roller-reamer may comprise a thrust sleeve interposed between a roller (e.g., first, second, third etc.) and the reservoir sleeve.

The lubricant system may comprise a displacement mechanism to displace lubricant from the reservoir. The displacement mechanism may develop a positive pressure within the lubricant reservoir to provide a bias for displacement towards the first (and any additional) roller. In one example the lubricant system may comprise a piston to displace lubricant from the reservoir. The lubricant system may comprise a spring mechanism which drives the piston to displace lubricant. The lubricant system may comprise a hydraulically operated displacement mechanism. In some examples the hydraulically operated displacement mechanism may be operable by fluid pressure surrounding the wellbore roller-reamer when in use. In this respect ambient fluid may be considered to form part of a lubricant circuit.

As noted above, the lubricant system may comprise a lubricant circuit (which may alternatively be defined as a means of distribution) to permit delivery of lubricant from the lubricant reservoir to the first and/or additional rollers when present. While the term "circuit" is used herein in connection with the delivery of a lubricant, it should be understood that this should not be limited to a system in which lubricant is both delivered from and returned to the lubricant reservoir.

The lubricant circuit may be in fluid communication with the lubricant reservoir. The lubricant circuit may comprise a channel, groove, slot or the like disposed or defined axially along the outer surface of the mandrel. The channel may contain or comprise a tube or similar structure to convey the lubricant. In some examples the channel may be at least partially enclosed with a cover to define a tube, conduit or the like.

The lubricant circuit may comprise a communication path through, for example radially through, the bearing sleeve of the first roller. The communication path may facilitate communication with the channel, groove or slot in the outer surface of the mandrel. The communication path may comprise one or more ports, such as radial ports extending through the bearing sleeve. In one example the bearing sleeve may comprise a recess, such as an annular recess which is in communication with the communication path through the bearing sleeve.

The communication path through the bearing sleeve may communicate lubricant to the external surface of the bearing sleeve. This arrangement may permit lubricant to be delivered to the space between the first roller and the bearing sleeve (or between any additional roller and their associated bearing sleeves).

A similar means of receiving lubrication may be provided in subsequent rollers (e.g. second, third) if present.

The wellbore roller-reamer may comprise an axial load mechanism to provide an axial load between components which are axially stacked on the mandrel. Such components may include the first and any additional rollers, spacer rings, thrust rings, the reservoir sleeve and the like. The axial load mechanism may thus provide an axial pre-load within the wellbore roller-reamer. The axial load mechanism may comprise a spring or spring assembly, such as a washer spring assembly or the like.

The axial load mechanism may provide sufficient axial force between the components to seal the lubricant of the lubrication system within the lubrication system and prevent leakage. Alternatively, seals may be required to retain lubricant within the system. The seals may take the form of face seals, radial seals, and/or the like.

The axial load mechanism may be energised to provide loading within the wellbore roller reamer by the provision of a load shoulder or similar structure within the wellbore roller reamer. Alternatively, the axial load mechanism may be energised upon connection, for example via a threaded connection, to a further component, such as a connector sub, drilling BHA and/or the like.

The mandrel may be tubular and define an internal flow path to facilitate communication of a fluid, such as a drilling fluid, therethrough.

The mandrel may comprise opposing end connectors to facilitate connection within a drill string or drilling BHA. The mandrel may comprise threaded connectors.

One end of the mandrel may comprise a male threaded portion. The male threaded portion may comprise a tapered threaded portion. The male threaded portion may form part of a service connector within the wellbore roller-reamer. The male threaded portion may form part of one half of a service-break. Such a service connector may be provided in such a manner to facilitate assembly, maintenance etc. of the wellbore roller-reamer, without or with minimal compromise to the ability of the tool to be connected to separate components in a robust manner.

The service connector may be used to directly connect the wellbore roller-reamer to a separate component, such as a tool string component, tubing string component, and the like, for example during the process of making up a tool or tubing string in the field. Alternatively, the service connector may facilitate connection with a connector sub, which may permit connection of the wellbore roller-reamer to a separate component.

The male threaded portion may be provided in accordance with an industry standard, such as an American Petroleum Institute (API) standard. This may allow the wellbore roller-reamer to readily interface with a range of existing string components.

The male threaded portion may be provided adjacent a mounting surface of the mandrel, upon which mounting surface the first roller is mounted. In some examples the first roller (and/or any additional components) may be mountable on the mandrel by sliding onto the mandrel over the male threaded portion. In this respect the male threaded portion may be of a size and form to permit the first roller (and/or any additional components) to pass thereover.

The wellbore roller-reamer may comprise a load sleeve defining a torque shoulder, wherein the load sleeve is mountable on the mandrel and securable adjacent the male threaded portion of the first end of the mandrel. In this arrangement the torque shoulder and the male threaded portion may together define a pin connector to facilitate connection with a box connector of a separate component. As such, the torque shoulder may be configured to engage a corresponding torque shoulder of a box connector.

The load sleeve may be mountable on the mandrel after the first roller, and any additional required components (e.g., further rollers, reservoir sleeve etc.) have been mounted/assembled on the mandrel. In this respect, a complete pin connector may not be fully formed during assembly of at least the first roller onto the mandrel, providing greater flexibility in terms of tool component design and the range of applications of the downhole tool. For example, assembly may be achieved without the complexity of having to fit components over an integral thread torque shoulder, which might otherwise require a significant reduction in possible tool diameter.

The load sleeve may be secured on the mandrel such that it can efficiently transfer axial and torsional loads—via the torque shoulder—to the mandrel from any separate component connected to the mandrel via the male threaded portion. The load sleeve may be securable on the mandrel such that it holds the first roller, and optionally any additional components, in place on the mandrel. As such, the load sleeve may have dual functionality of providing the torque shoulder for a robust threaded connection, and securing components on the mandrel.

Numerous possibilities for securing the load sleeve relative to the mandrel may be provided, such as interference fitting, keys and keyways, splined, cooperating ribs and channels, non-round profiles and the like.

The mandrel may be a unitary component. Alternatively, the mandrel may comprise multiple components which are assembled together.

An aspect of the present disclosure relates to a reamer roller assembly for a wellbore roller-reamer, comprising:

- a bearing sleeve defining a sleeve bore to permit mounting on a mandrel, wherein the bearing sleeve defines a sleeve bore axis; and
- a roller circumscribing the bearing sleeve and having an outer reaming surface, wherein the roller is rotatable relative to the bearing sleeve about a roller axis.

The reamer roller assembly may be configured for use with a wellbore roller-reamer according to any other aspect of the present disclosure, and as such features defined in relation to any other aspect are considered to form part of the present aspect directed to the reamer roller assembly.

The bearing sleeve may be configured to be rotatably fixable relative to a mandrel of a wellbore roller-reamer. In this case the roller may be rotatable relative to both the bearing sleeve and the mandrel.

The sleeve bore axis and the roller axis may be offset from each other, for example laterally offset. As such, the roller may be provided with a degree of eccentricity relative to the bearing sleeve. When mounted on a mandrel of a wellbore roller-reamer, the offset between the axes may be such that, during use, rotation of the mandrel with the outer reaming surface of the roller engaged with a wall of a wellbore will cause the roller to be driven to rotate relative to the mandrel and ream the wall of the wellbore.

In some examples the reamer roller assembly may be configured to be assembled prior to mounting or installing on the mandrel. Alternatively, the roller assembly may be at least partially assembled on the mandrel.

The bearing sleeve may be circumferentially continuous. Alternatively, the bearing sleeve may be circumferentially discontinuous, for example provided in two or more circumferential segments which are assembled together to define the complete bearing sleeve. In one example the roller, once mounted on the assembled bearing sleeve, may assist to hold the circumferential segments together.

The bearing sleeve may be configured such that when mounted on a mandrel the sleeve bore axis is concentric with a mandrel axis. Alternatively, the sleeve axis may be offset relative to the mandrel axis.

The bearing sleeve may define a varying circumferential wall thickness to facilitate the roller axis being offset form the sleeve bore axis. In one example the bearing sleeve may define an inner cylindrical surface and an outer cylindrical surface, wherein the inner and outer cylindrical surfaces are eccentrically arranged. Such eccentric alignment of the inner and outer surfaces may permit the roller axis to be offset form the sleeve bore axis.

The bearing sleeve may define a bearing surface to facilitate relative rotation between the bearing sleeve and the first roller. The bearing sleeve may define a plain bearing, friction bearing or the like. In some examples the bearing surface may be circumferentially continuous. Alternatively, the bearing surface may be defined by at least one, and in some examples a plurality of discrete bearing surfaces. Each discrete bearing surface may define a portion of a cylindrical surface.

The roller assembly may comprise at least one bearing element interposed between the roller and the bearing sleeve. The at least one bearing element may comprise a friction bearing element. The at least one bearing element may comprise a low-friction material. The at least one bearing element may comprise at least one bearing pad. The at least one bearing element/pad may extend at least one of axially, circumferentially and spirally relative to the bearing sleeve.

A plurality of bearing elements may be provided. In some examples the plurality of bearing elements may be at least one of circumferentially and axially distributed relative to each other.

One or more of the at least one bearing elements may be integrally formed with one of the roller and the bearing sleeve. One or more of the at least one bearing elements may be separately formed and subsequently mounted between the roller and the bearing sleeve. One or more of the at least one bearing element may be replaceable.

The bearing sleeve may define at least one pocket configured to receive at least one bearing element. The roller may define at least one pocket configured to receive at least one bearing element.

In some examples one or more of the at least one bearing elements may be arranged to provide or contribute to providing the lateral offset of the roller axis. In one example one or more of the at least one bearing elements may comprise or define a varying outer dimension. For example, a single bearing element may define a varying outer dimension. Alternatively, or additionally, first and second bearing elements which are circumferentially separated may extend to different radial extents relative to the sleeve bore axis.

The reamer roller assembly may comprise a seal arrangement between the roller and the bearing sleeve. The seal arrangement may comprise one or more O-rings or the like.

The reamer roller assembly may comprise an axial thrust assembly for engagement with a separate component. The thrust assembly may comprise at least one thrust ring. In one example a thrust ring may be provided at opposing axial ends of the reamer roller assembly. The bearing sleeve may support a thrust ring.

In some examples the outer reaming surface may extend continuously around the circumference or outer periphery of the first roller. However, in other examples the outer reaming surface may extend discontinuously around the circumference or outer periphery of the first roller. Such a discontinuous outer reaming surface may facilitate improved bypass of fluids and/or debris past the first roller during use.

The first roller may comprise at least one bypass recess which extends axially along the outer surface of the first roller. The at least one bypass recess may be defined by one or more regions of relief relative to the outer reaming surface of the first roller.

When the wellbore roller-reamer is in use, the at least one bypass recess may assist to improve bypass of fluid and/or debris past the first roller.

The at least one bypass recess may be defined by one or more of grooves, slots, channels, flutings and/or the like.

The at least one bypass recess may be aligned axially along the length of the first roller. Alternatively, or additionally, the at least one bypass recess may be arranged helically along the length of the first roller. Such a helical path may allow the projected circumference of the outer reaming surface of the roller to create full 360 degree coverage. Alternatively, the helical path may permit partial circumferential coverage of the outer reaming surface (e.g. 270 degree coverage).

A 360 degree coverage may permit operation of the wellbore reamer tool to be more efficient and the tool less susceptible to wash-out sections. Partial coverage (e.g. 270 degree coverage) profiles may allow for more freedom of movement of drilling fluids and rock debris.

The presence of the at least one bypass recess may be such that the outer reaming surface extends discontinuously around the circumference or outer periphery of the first roller.

In some examples a plurality of bypass recesses may be provided in the outer surface of the first roller. The first roller may comprise a plurality of circumferentially arranged discrete portions of the outer reaming surface separated by respective bypass recesses.

In one example the first roller may comprise a plurality of rib structures extending outwardly (e.g., radially) of the first roller, wherein each rib structure defines a discrete portion of the outer reaming surface of the first roller. The rib structures may be separated by respective bypass recesses. The rib structures may be aligned axially along the length of the first roller. Alternatively, or additionally, the rib structures may be arranged helically along the length of the first roller.

The outer reaming surface of the first roller (or discrete portions thereof which may be provided on rib structures, as noted above) may define a suitable geometry or composition to provide efficient wellbore reaming. The outer reaming surface may comprise at least one, and in some examples a plurality of inserts to provide a reaming structure. The inserts may comprise any suitable hard material such as tungsten carbide, diamond impregnated matrix, hardened steel or the like. The inserts may be one or more of brazed, sprayed/welded or otherwise deposited onto the outer reaming surface.

An aspect of the present disclosure relates to a method for reaming a wellbore using a wellbore roller-reamer according to any other aspect.

An aspect of the present disclosure relates to a drill string, comprising a drill bit at a distal end of the drill string and a wellbore roller-reamer according to any other aspect axially spaced form the drill bit.

In the aspects defined above, focus is presented on a wellbore roller-reamer, or components for use in a wellbore roller-reamer. However, principles of the present disclosure may also be applied to other tools or tool systems, whether for use in a wellbore or otherwise.

In this respect, an aspect of the present disclosure relates to a tool, comprising:

a mandrel rotatable about a mandrel axis;

a first roller mounted around a circumference of the mandrel and being rotatable relative to the mandrel about a first roller axis which is offset from the mandrel axis.

Features defined in relation to one aspect are also intended to be defined in relation to any other aspect.

BRIEF DESCRIPTION OF THE DRAWINGS

These and other aspects and examples of the present disclosure will now be described, by way of example only, with reference to the accompanying drawings, in which.

DETAILED DESCRIPTION OF THE DRAWINGS

Figure 1:
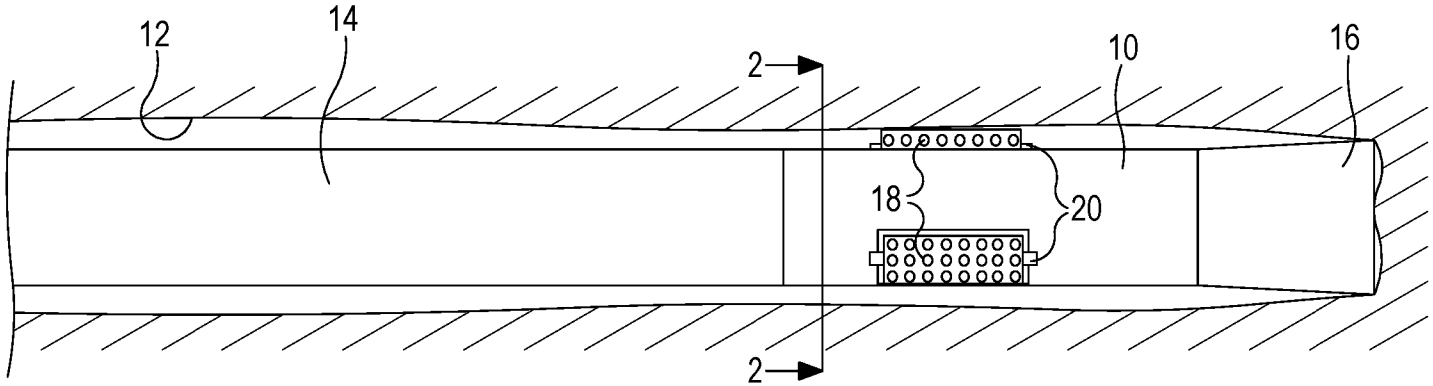
FIG. 1 is a diagrammatic illustration of a known roller reamer.
Figure 2:
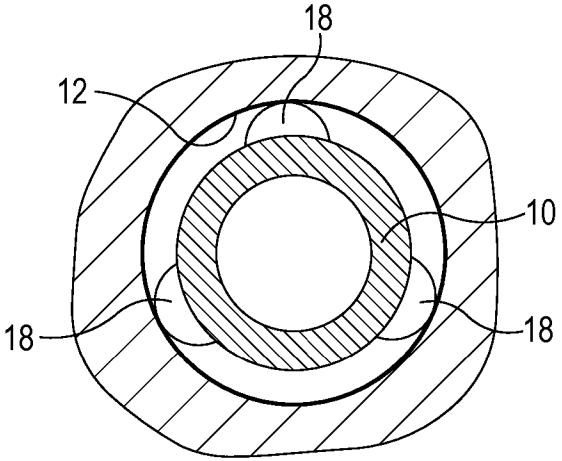
FIG. 2 is a cross-section along line 2-2 of FIG. 1.
Figure 3:
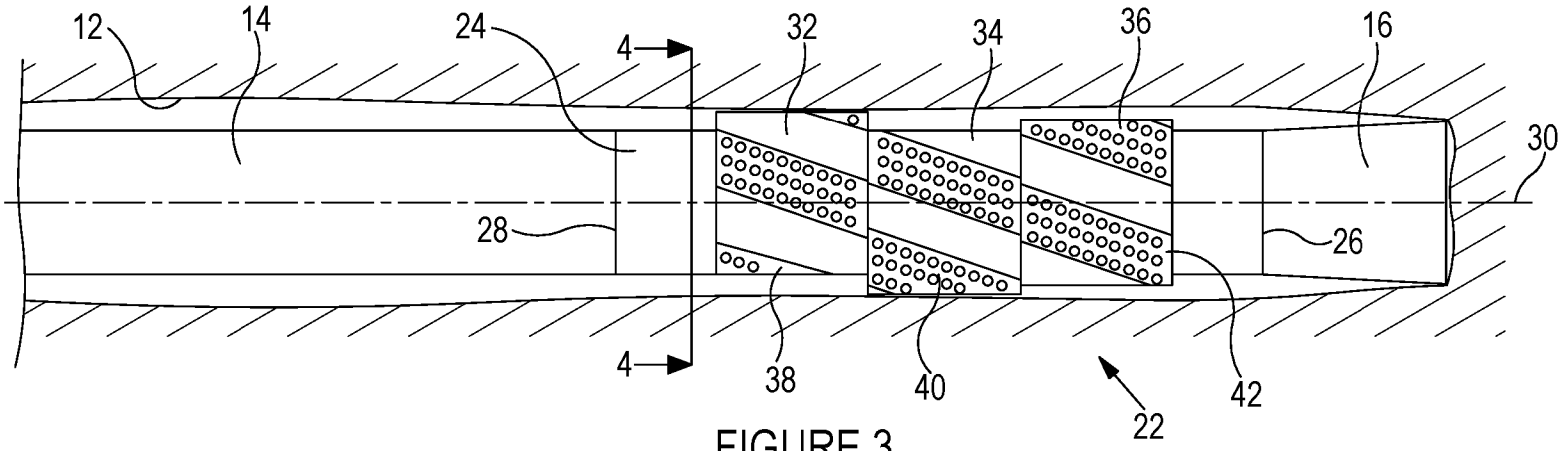
FIG. 3 is a diagrammatic illustration of a wellbore roller-reamer in accordance with an example of the present disclosure.
Figure 4:
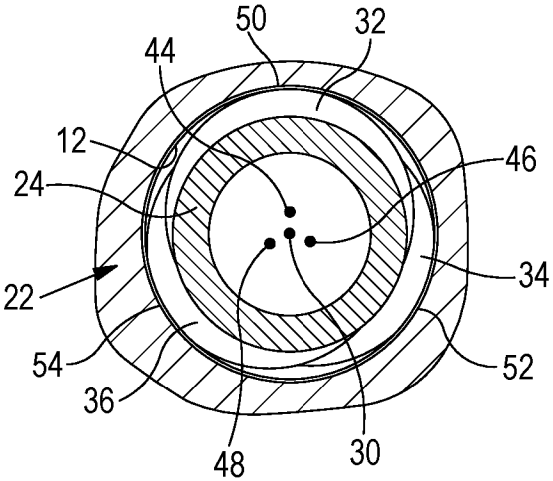
FIG. 4 is a cross-section along line 4-4 of FIG. 3.

An example wellbore roller-reamer, generally identified by reference numeral 22, is diagrammatically illustrated in FIG. 3 located within a wellbore 12, with FIG. 4 providing a cross-section through line 4-4 of FIG. 3. The roller-reamer tool 22 includes a tubular mandrel 24 which defines a mandrel axis 30, and is secured to a drill bit or bottom hole assembly 16 via a first connector 26, and to a drill string 14 via a second connector 28. The mandrel 24 and drill bit 16 are rotated by the drill string 14.

The wellbore roller-reamer 22 in the present example includes three axially arranged reamer rollers 32, 34, 36 (more or less rollers could be provided) which are rotatably mounted around (and thus circumscribe) the mandrel 24, wherein each roller 32, 34, 36 includes a respective reaming surface or structure 38, 40, 42 configured to engage and ream the wall of the wellbore 12. Each roller 32, 34, 36 defines a respective roller axis 44, 46, 48 (FIG. 4), about which axes the rollers 32, 34, 36 rotate. In the present example the roller axes 44, 46, 48 are each laterally offset from the mandrel axis 30, and also from each other. Specifically, the lateral offset between the roller axes 44, 46, 48 is such that these are evenly circumferentially distributed around the mandrel axis 30 (i.e., 120 degrees apart).

The lateral offset of the various axes eccentrically arranges the individual rollers 32, 34, 36 relative to the mandrel 24 at a circumferential phasing, and thus establishes respective reaming contact points 50, 52, 54 between each roller 32, 34, 36 and the wall of the wellbore 12, with the contact points 50, 52, 54 being both circumferentially and axially distributed relative to each other. The provision of such axially and circumferentially distributed reaming contact points 50, 52, 54 may provide benefits over prior art designs. For example, the distributed contact points may assist to provide a degree of centralising of the wellbore roller-reamer 22 within the bore 12 during forming. Further, the roller-reamer 22 may provide a stabilising function, perhaps facilitating better control of the trajectory of the drill bit 16.

It should be noted that the lateral offset between axes and the corresponding eccentric mounting of the rollers has been exaggerated in FIGS. 3 and 4 for illustration purposes.

The offset between the mandrel axis 30 and the roller axes 44, 46, 48, combined with the contact with the bore wall, facilitates each roller 32, 34, 36 to be rotatably driven during rotation of the mandrel 24. In this case the rollers 32, 34, 36 and associated reaming contact points 50, 52, 54 will effectively orbit the wellbore 12, thus providing the mechanism by which the wellbore roller-reamer 22 effectively reams the wellbore 12. It will be appreciated that the established relative rotation between the mandrel 24 and rollers 32, 34, 36 is counter rotation, such that when the mandrel 24 rotates in a first direction, the rollers 32, 34, 36 are driven to rotate in a reverse second direction.

By mounting the rollers around (i.e., circumscribing) the mandrel the rollers may thus be permitted to define a larger diameter, which may mitigate issues associated with smaller dimeter rollers in prior art reamers.

Figure 5:
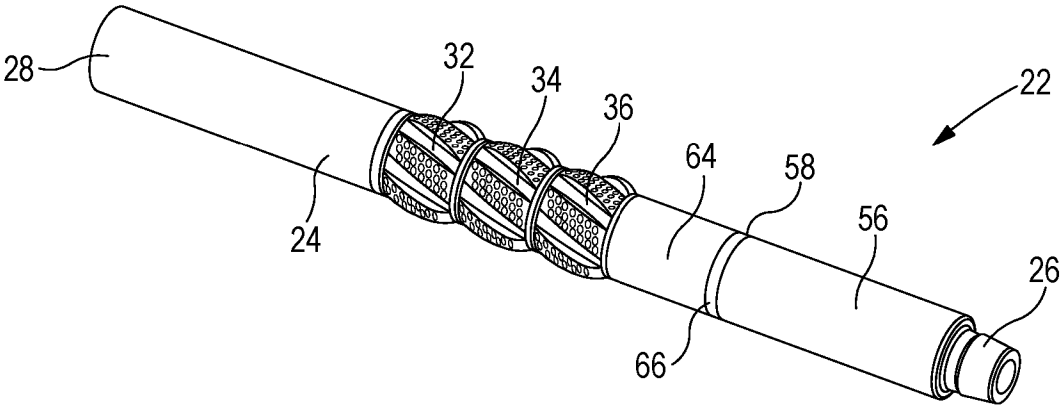
FIG. 5 is a perspective view of a wellbore roller-reamer in accordance with an example of the present disclosure.

A more detailed description of the roller reamer 22 will now be described, initially with reference to FIG. 5 which is a perspective view of the roller reamer 22, and FIG. 6 which is a part sectional view of the roller reamer 22 in FIG. 5.

As noted above, the roller-reamer 22 includes a mandrel 24 which rotatably supports three axially distributed and eccentrically arranged rollers 32, 34, 36. One end of the roller reamer 22 includes the connector 28, specifically a box connector, which facilitates connection to a drill string (see 14 in FIG. 3). The roller-reamer 22 further includes a connector sub 56 which includes the connector 26, specifically a pin connector, which facilitates connection to a drilling BHA (see 16 in FIG. 3). The connector sub 56 is secured to the mandrel 24 via a threaded connection 58.

Specifically, the end of the mandrel 24 includes a male pin thread 60 which is received within a female box connector 62 of the connector sub 56. The connector sub 56 may therefore be used to axially secure the various components on the mandrel 24. As such, the threaded connection 58 may function as a service connector/break within the roller-reamer 22, for example to facilitate assembly of components.

In the present example the roller-reamer 22 further includes a lubrication system 64, which will be described in more detail below. The roller-reamer 22 further includes a spring assembly 66 interposed between the lubrication system 64 and connector sub 56. In this respect the spring assembly 66 is energised when the connector sub 56 is coupled to the mandrel 24, thus providing an axial pre-load between the mandrel 24, rollers 32, 34, 36 and lubrication system 64.

Figure 6:
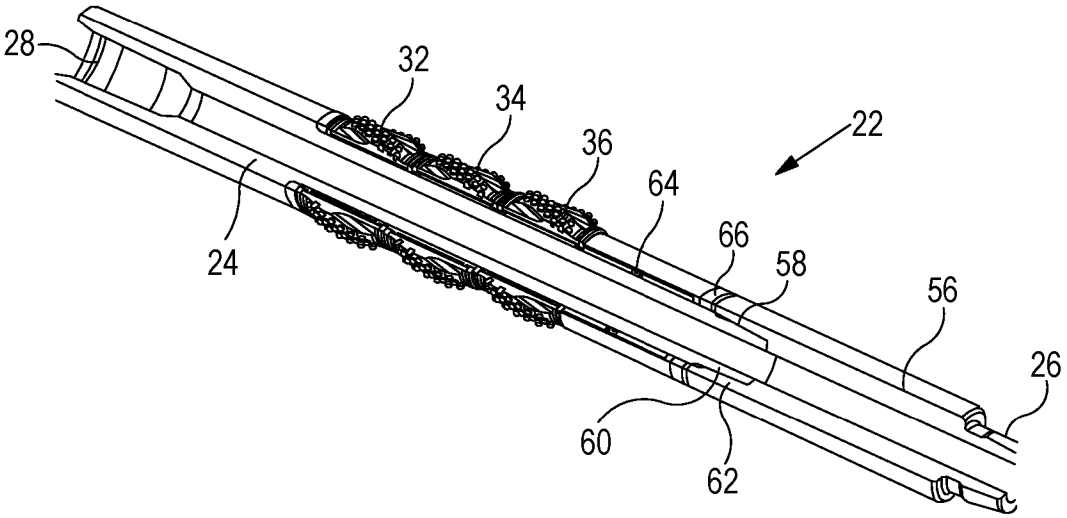
FIG. 6 is a sectional perspective view of the roller reamer of FIG. 5.
Figure 7:
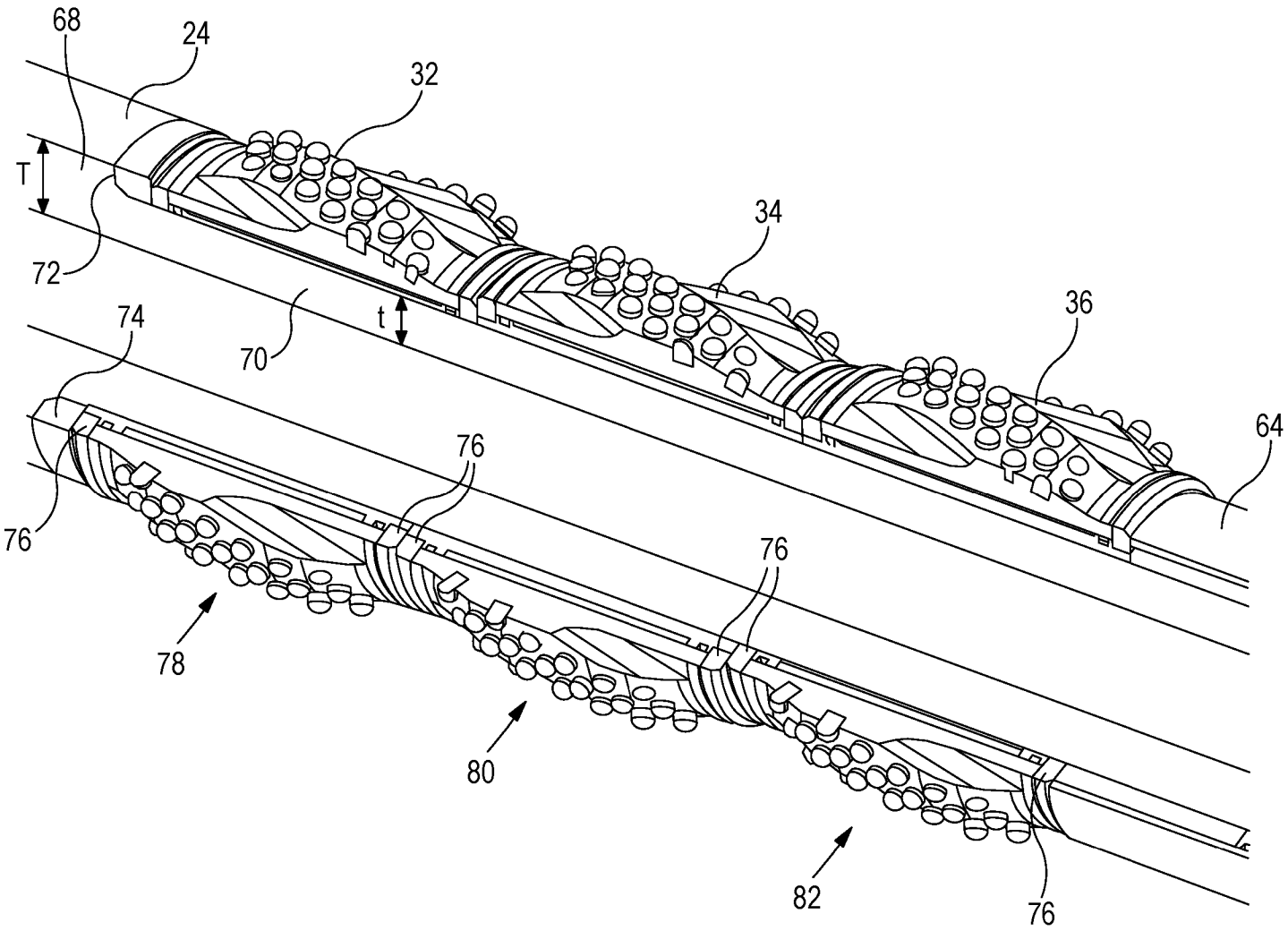
FIG. 7 is an enlarged sectional view of roller assemblies of the roller reamer of FIG. 5.

Reference is now made to FIG. 7 which is an enlarged view of the roller-reamer 22 illustrated in FIG. 6, in the region of the rollers 32, 34, 36. The mandrel 24 includes a first axial section 68 which defines a first wall thickness T, and an adjacent second axial section 70 which defines a reduced wall thickness t, wherein the rollers 32, 34, 36 are each rotatably mounted around the second axial section 70. An annular shoulder 72 defines a stepped transition between the different wall thicknesses T, t, wherein the annular shoulder 72 includes a radiused root for stress management purposes. In the present example a spacer ring 74 is provided between roller 32 and the annular shoulder 72, wherein the spacer ring 74 matches the radiused profile of the shoulder 72. Furthermore, adjacent rollers 32, 34, 36 are separated by thrust rings 76, and similarly a thrust ring 76 is interposed between roller 32 and spacer ring 74, and between roller 36 and lubrication system 64.

Figure 9:
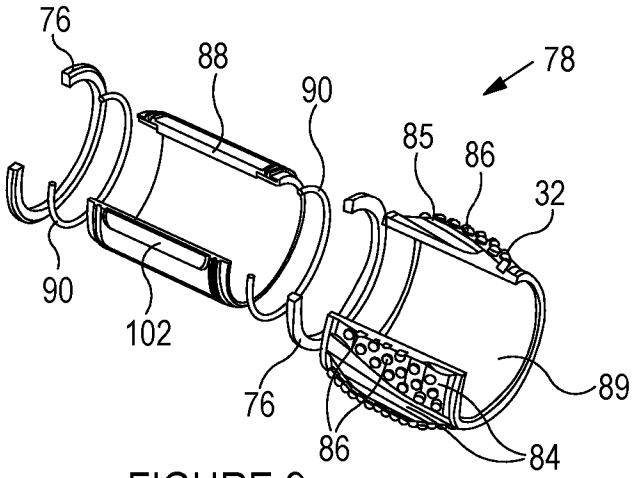
FIG. 9 is a sectional and exploded view of the roller assembly of FIG. 8.
Figure 8:
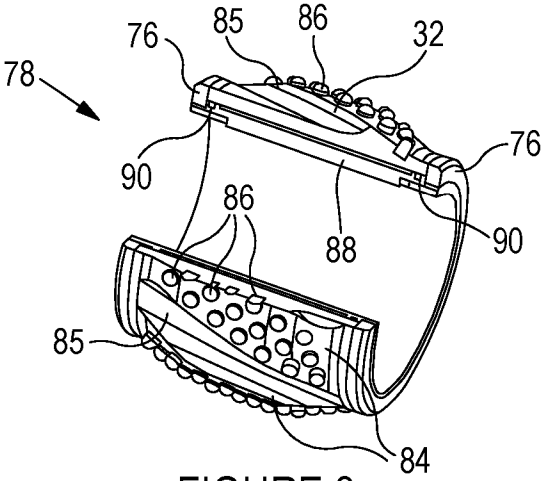
FIG. 8 is a sectional perspective view of a single roller assembly of the roller reamer of FIG. 5.

In the present example the rollers 32, 34, 36 are included as part of respective identical roller assemblies 78, 80, 82, which will now be described in detail. In this respect reference is now made to FIG. 8 which is a sectional view of roller assembly 78, and FIG. 9 which is an exploded sectional view of the same roller assembly 78.

The roller 32 includes a series of rib structures 84 upon which are mounted a number of reaming/cutting inserts 86 formed from a suitably hard wearing material, such as tungsten carbide. In this respect the outer surfaces of the ribs 84 define discrete portions of a discontinuous outer reaming surface of the roller 32.

The rib structures 84 are circumferentially separated by recesses 85 which each extend axially along the roller 32. The recesses 85 may be defined as bypass recesses in that they retain a degree of flow bypass area past the roller 32 when the wellbore roller-reamer 22 is in use. In this respect, and as noted above, by mounting the rollers around the mandrel 24 the rollers may be permitted to define a larger diameter than known roller-reamers. As a consequence, however, when the wellbore roller-reamer 22 is in use the rollers may occupy a substantial section of the bore, such that fluid bypass may be restricted. The provision of the bypass recesses 85 may address this possible restriction issue by providing a larger bypass flow area.

The roller 32 is circumferentially and rotatably mounted on a bearing sleeve 88, with O-ring seals 90 provided therebetween. Thrust rings 76 are also mounted on the bearing sleeve 88, on opposing sides of the roller 86.

Figure 10:
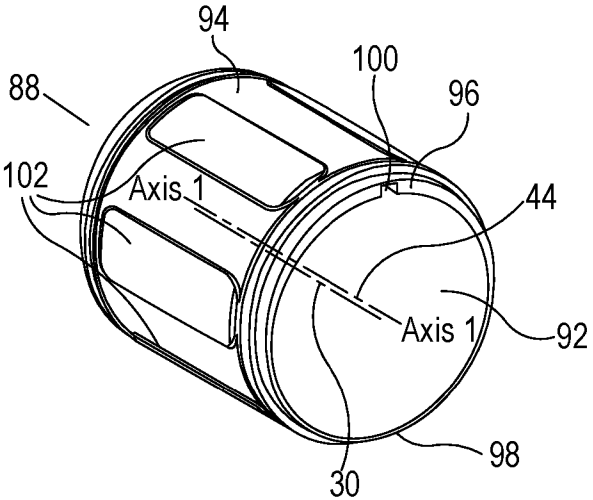
FIG. 10 is a perspective view of a bearing assembly which forms part of the roller assembly of FIG. 8.

A complete bearing sleeve 88 is illustrated in FIG. 10, reference to which is additionally made. The bearing sleeve 88 defines a cylindrical inner surface 92 which facilitates mounting of the roller assembly 78 on the mandrel 22. The bearing sleeve 88 also includes an outer generally cylindrical surface 94. The wall thickness of the bearing sleeve 88 varies, from its thickest region 96 to its thinnest region 98 on a diametrically opposing side. The nature of the variation in wall thickness is such that the inner and outer cylindrical surfaces 92, 94 are eccentrically arranged, with the inner surface 92 being generally concentric with the mandrel axis 30 (when mounted on the mandrel 24), and the outer surface 94 being generally concentric with the roller axis 44. As such, in the present example it is the variation in wall thickness and eccentricity of the bearing sleeve 88 which facilitates the lateral offset of the axes 30, 44.

The bearing sleeve 88 further includes a longitudinal recess 100 on the inner surface 92, specifically at the location of the thickest wall region 96. As will be described in more detail below, the recess 100 facilitates alignment and rotatably securing the bearing sleeve 88 on the mandrel.

Figure 11:
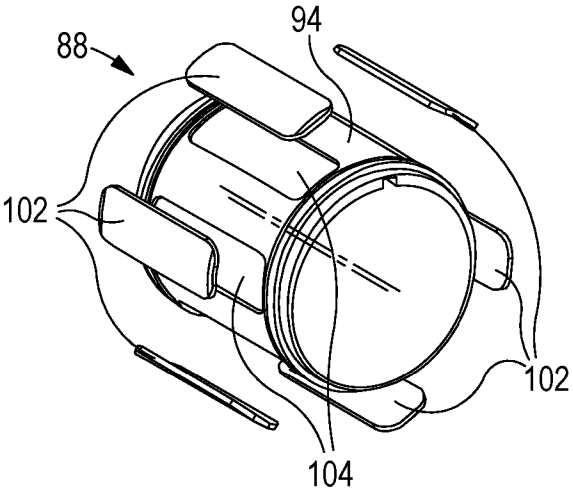
FIG. 11 is an exploded view of the bearing assembly of FIG. 10.
Figure 12:
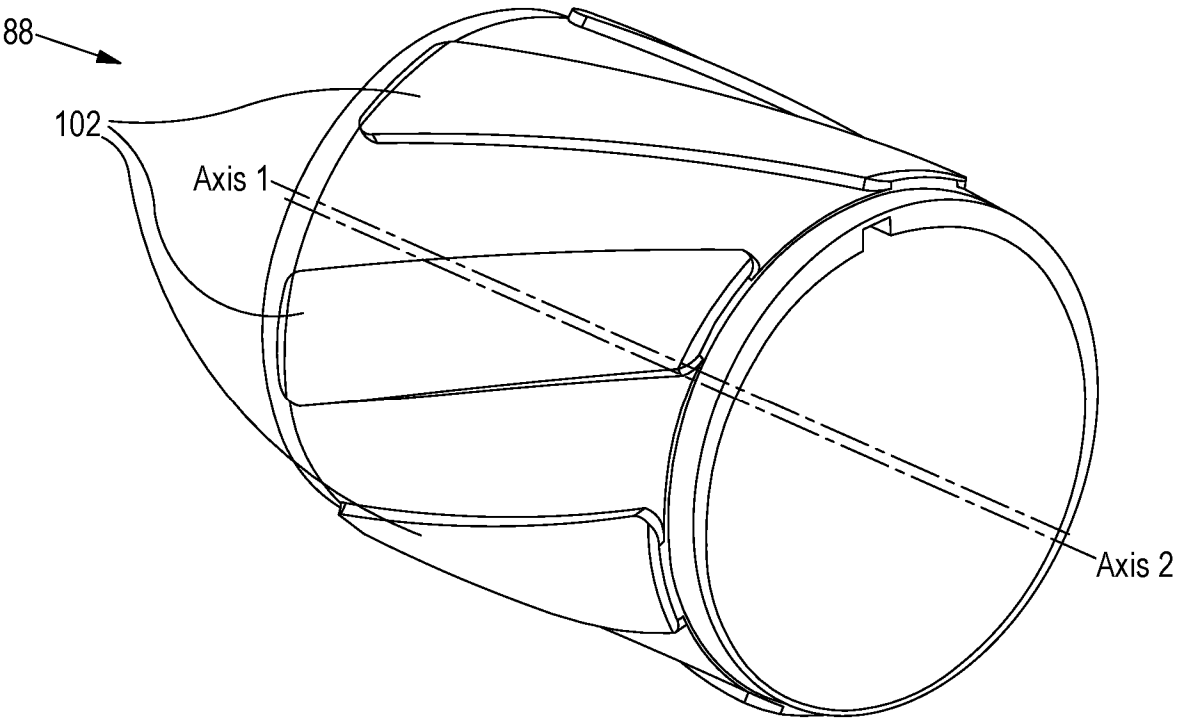
FIG. 12 is a perspective view of an alternative form of a bearing assembly.

The bearing sleeve 88 further includes a circumferential array of bearing pads 102 extending outwardly from the outer surface 94. The bearing pads 102 may be composed of a low friction material, and provide rotatable bearing engagement with the inner surface of the roller 32. The bearing pads 102 may be integrally formed with the bearing sleeve 88, as shown in FIG. 10, or alternatively may be provided as separate inserts mounted in pockets 104 formed in the outer surface 94 of the bearing sleeve 88, as illustrated in FIG. 11. In the examples of FIGS. 10 and 11, the individual bearing pads 102 extend axially. However, in a further example, as shown in FIG. 12, the bearing pads 102 may extend helically. In an alternative example (not illustrated) bearing pads may be provided on or in the inner surface of the roller 32. Furthermore, the radial extent of individual bearing pads may vary, which may provide eccentric mounting of the roller 32.

Figure 13:
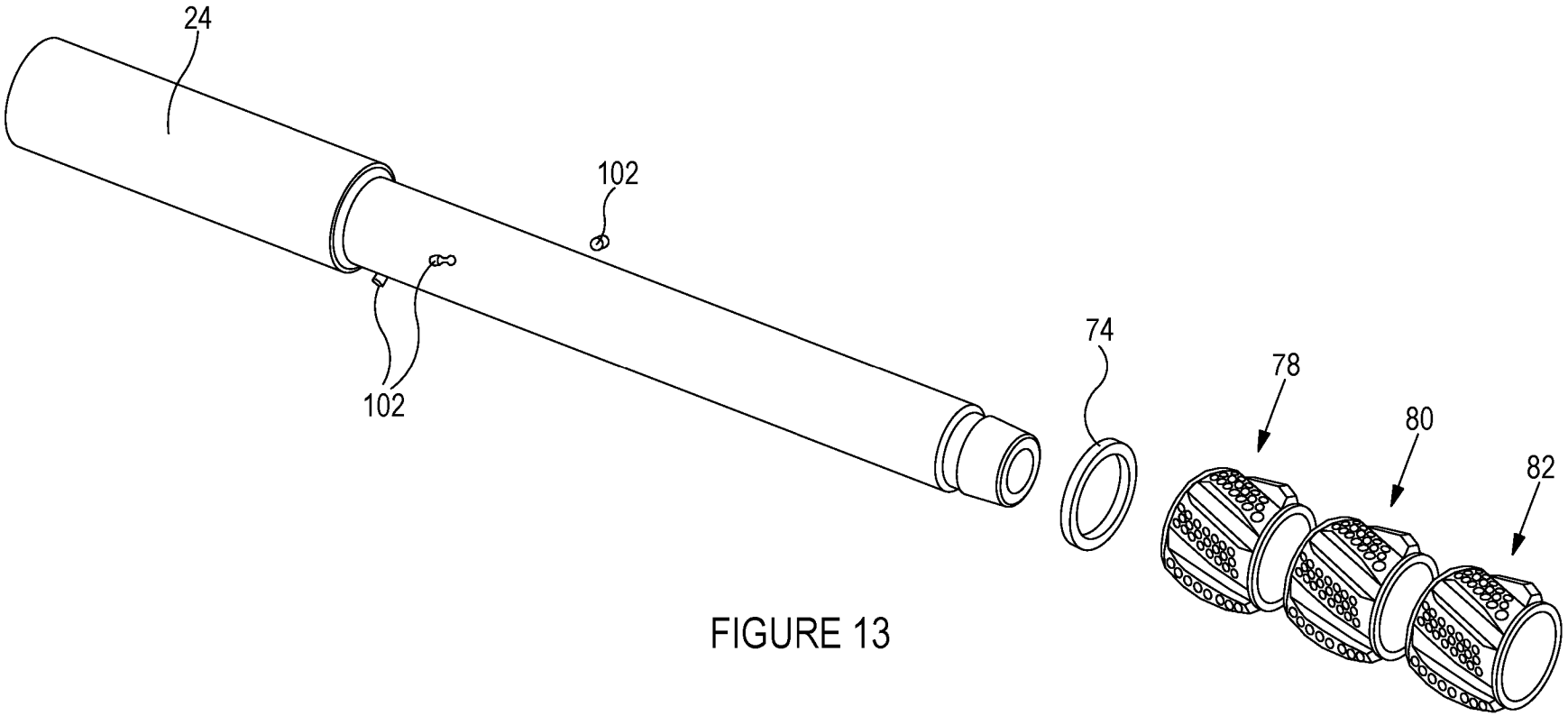
FIG. 13 is an exploded view of a mandrel and roller assemblies of the roller-reamer of FIG. 5.

As described previously, the roller assemblies 78, 80, 82 (FIG. 7) are configured identically. In this respect, the variation in lateral offset between the individual rollers 32, 34, 36 is achieved by varying the mounting alignment of the respective bearing sleeves 88 on the mandrel 24, as illustrated in FIG. 13, which is an exploded view of the mandrel 24 and roller assemblies 78, 80, 82. As described above, the bearing sleeve of each roller assembly includes a longitudinal recess 100. The roller assemblies 78, 80, 82 may thus be mounted onto the mandrel 24 such that the individual recesses 100 are engaged with respective keys 102 which are secured in any suitable way to the mandrel 24 at the desired circumferential spacing. In this way the roller assemblies may be mounted with a defined rotational offset, with the keys 102 also functioning to rotatably lock the bearing sleeves 88 to the mandrel 24.

Figure 14:
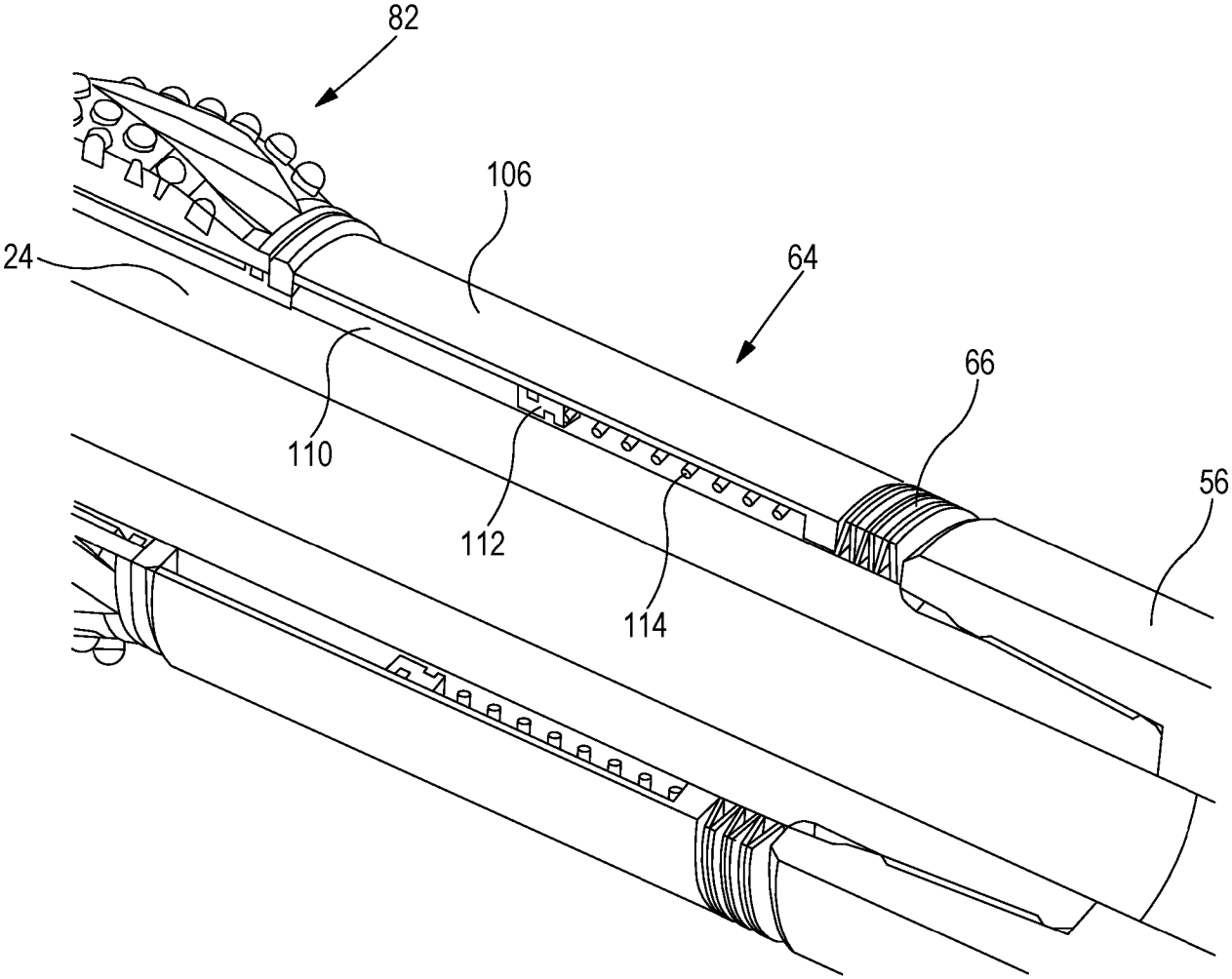
FIG. 14 is an enlarged sectional view of a lubrication system of the roller-reamer of FIG. 5.

Reference is now made to FIG. 14 which is an enlarged view of the roller-reamer 22 illustrated in FIG. 6, in the region of the lubrication system 64. The lubrication system 64 includes a reservoir sleeve 106 mounted around the mandrel 24 and between roller assembly 82 and spring system 66. The reservoir sleeve 64 defines an annular space 110 with the outer surface of the mandrel 24, which is configured to accommodate a lubricant, such as grease, oil or the like. An annular piston 112 is sealably mounted in the annular spaces 110, and is acted upon by a spring 114, such that the spring 114 and piston 112 apply a positive pressure on the lubricant in the annular space 110. In this respect the lubricant may be displaced and fed towards the roller assemblies to provide suitable lubricating effect. A lubricant circuit communicates lubricant from the annular reservoir space 110 towards the roller assemblies. The lubricant reservoir may be defined by spaces etc. formed between different components of the roller-reamer 22. Further, the lubricant circuit may be provided by various grooves, ports, slots, annuli and the like throughout the assembly. An example form of a lubricant circuit will be provided later below.

The nature of the present roller-reamer 22 is such that the volume of lubricant which can be accommodated represents a significant improvement over the prior art. Any variation in the required reservoir volume may be readily adjusted by simple selection of the length of mandrel 24 and reservoir sleeve 106.

Figure 15:
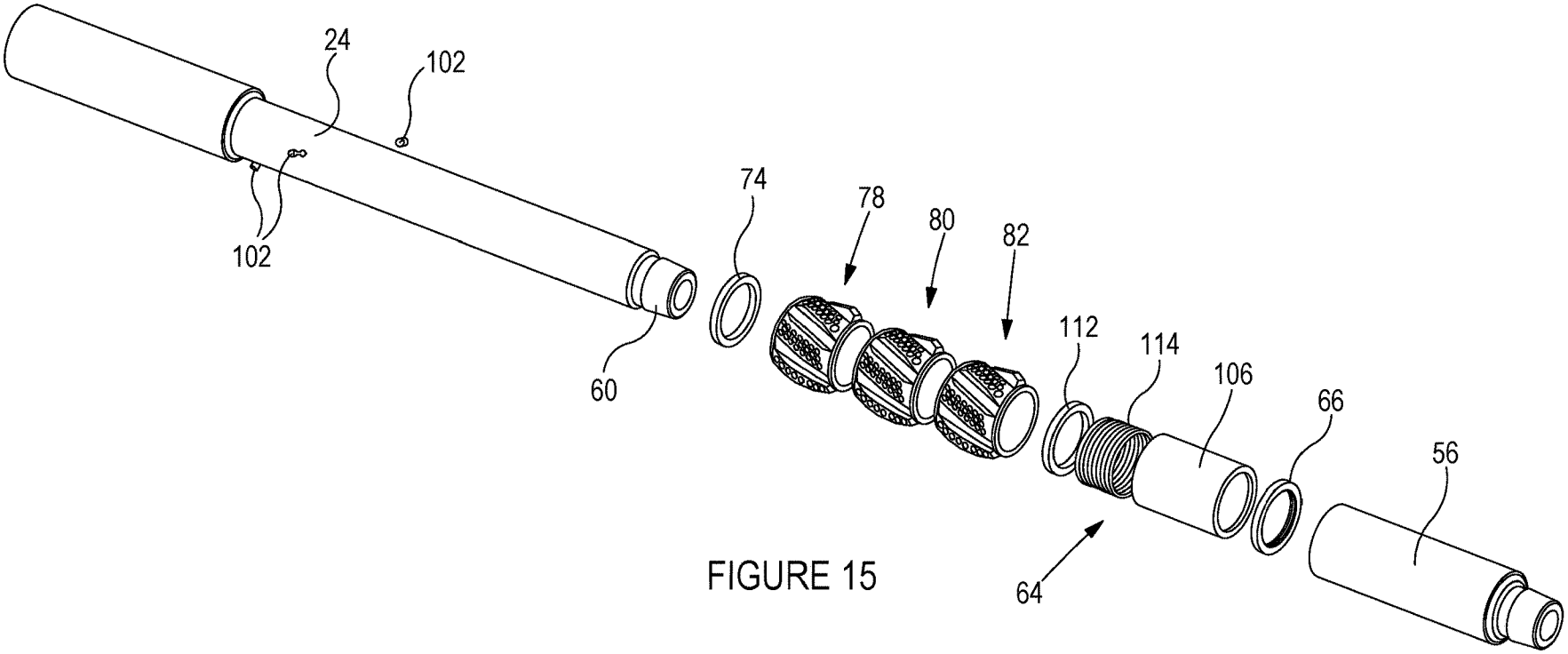
FIG. 15 is a complete exploded view of the roller-reamer of FIG. 5.

FIG. 15 is an exploded view of the roller reamer 22, which illustrates the sequence of assembly. In this respect, the sequence may involve mounting the spacer ring 75 on the mandrel 24 and installing the keys 106. The roller a roller assemblies 78, 80, 82 may then be mounted on the mandrel 24, with their alignment dictated by the position of the keys 106. The lubrication system 64 is then formed by mounting the piston 112, spring 115 and reservoir sleeve 106 on the mandrel 24, in addition to a suitable volume of lubricant. The spring system 66 is then mounted, and the connector sub secured to the mandrel via the male threaded portion 60, which functions to axially secure all components to the mandrel 24, with axial preloading provided by the spring system 66.

In the example provided above the connector sub 56 is secured to the mandrel 24 via the male threaded portion 60 on the end of the mandrel. While this may be entirely sufficient in many circumstances, there may be requirements where a more robust connection is required, which includes a suitable thread torque shoulder against which the connector sub can rotationally and axially engage to provide a desired coupling torque. In this respect a further example wellbore roller-reamer 122 which includes such a facility is shown in FIGS. 16 and 17, reference to which is now made.

Figure 16:
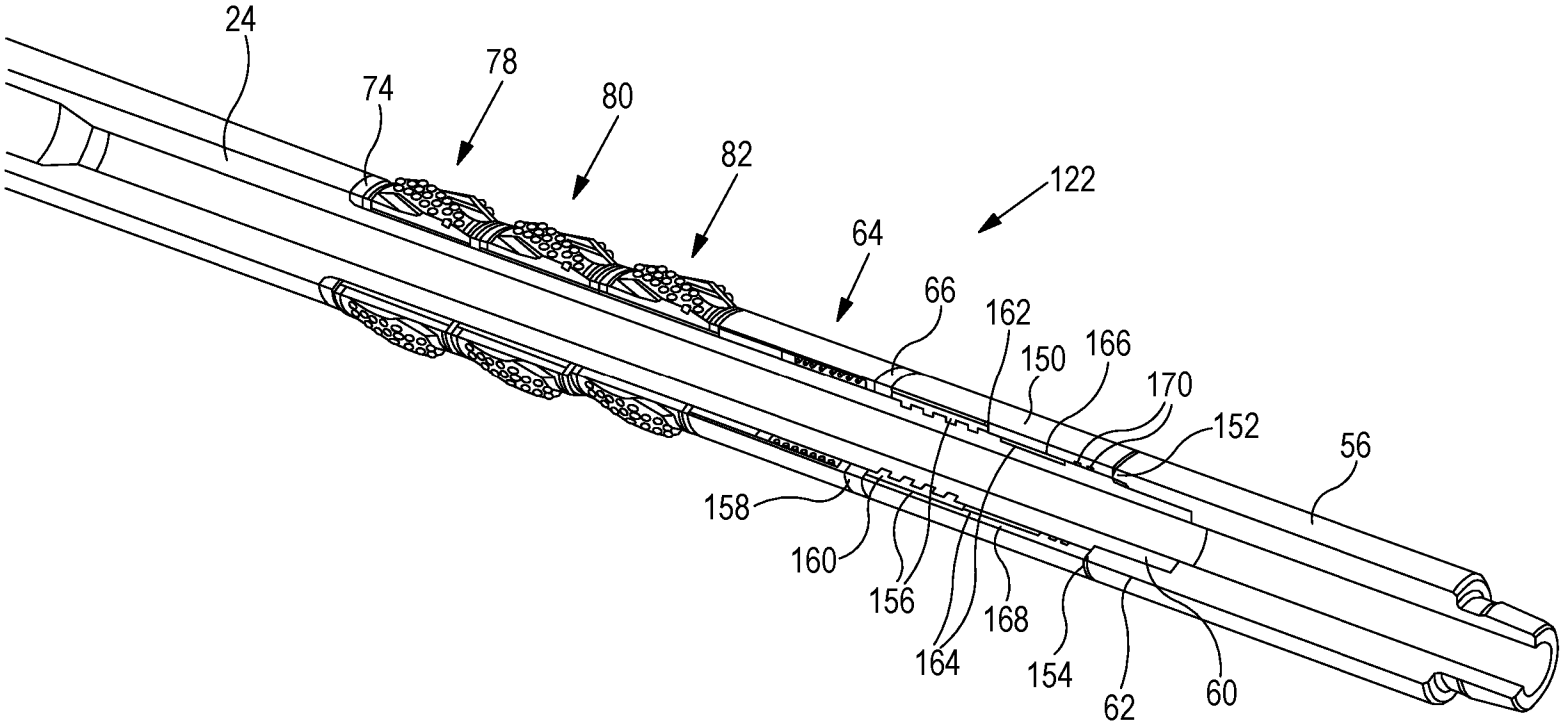
FIG. 16 is a sectional perspective view of a roller-reamer according to an example of the present disclosure.
Figure 17:
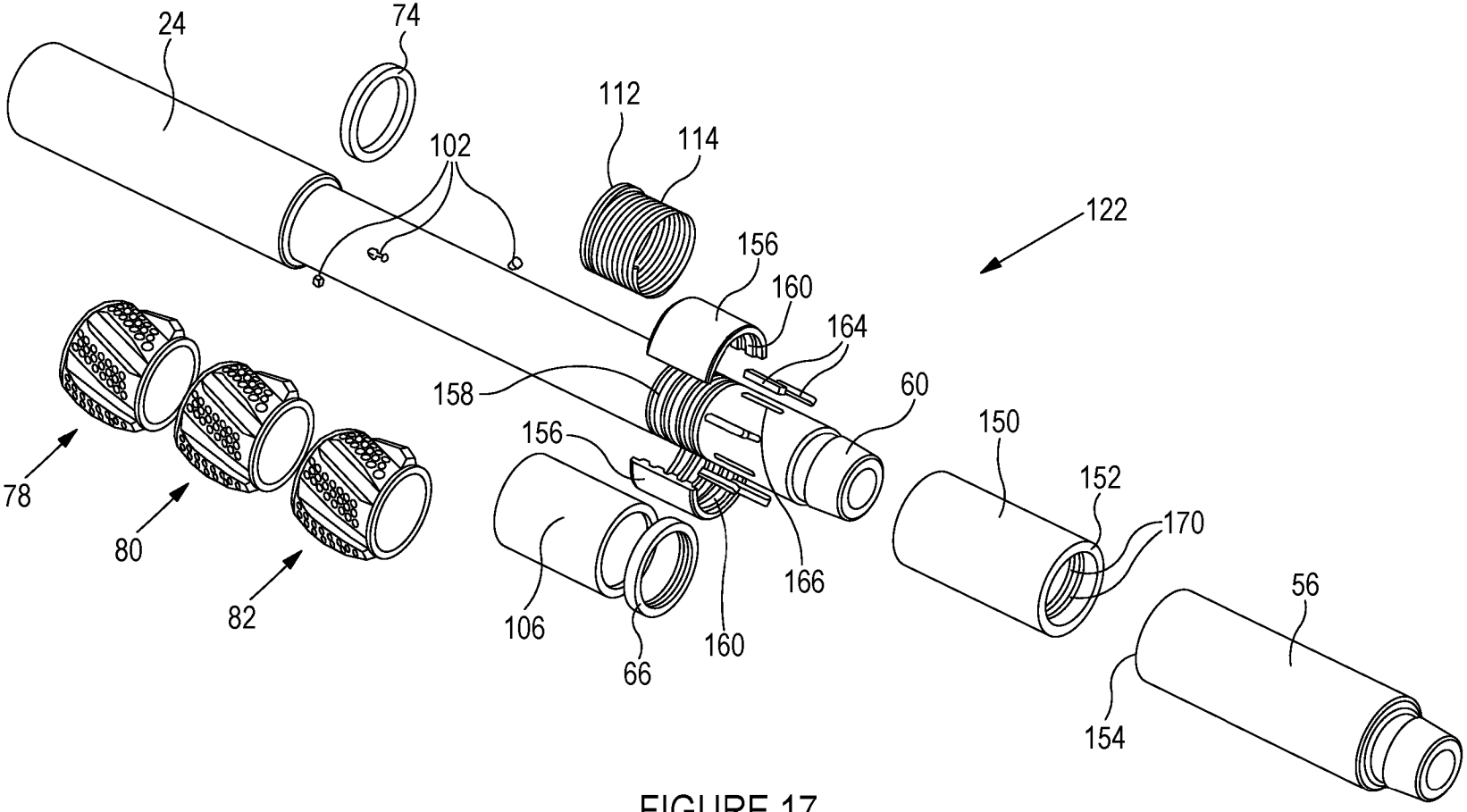
FIG. 17 is an exploded view of the roller-reamer of FIG. 16.

FIG. 16 provides a sectional perspective view of the assembled roller-reamer 122, whereas FIG. 17 provides an exploded view of the roller-reamer 122. The example roller-reamer 122 in FIGS. 16 and 17 is similar in many respects to the example described above (roller-reamer 22), and as such for brevity identical components and features have been identified by the same reference numerals, with minimal additional description provided. Thus, the roller reamer 122 also includes:

- a mandrel 24 which includes a male threaded portion 60 at one end;
- roller assemblies 78, 80, 82 mounted on the mandrel 22 and located/aligned via keys 106;
- a lubrication system 64 formed from a reservoir sleeve 106, annular piston 112 and spring 114;
- a spring system 66; and
- a connector sub 56 connectable to the male thread portion 60 of the mandrel 24.

In the present example, however, the roller-reamer 122 further includes a load sleeve 150 which is axially interposed between the spring system 66 and the connector sub 56, with the mandrel length being extended to accommodate. The load sleeve 150 comprises an axial torque shoulder 152 which is engaged by a corresponding torque shoulder 154 of the box connector 62 of the connector sub 56, thus providing a very robust and conventional pin and box type connection.

There are multiple possible options to facilitate suitable mounting and connection of the load sleeve 150 on/to the mandrel 24. In the present example, a split load ring 156 is axially secured to the mandrel 24 via complementary circumferential grooves 158 and ribs 160. Mounting of the load sleeve 150 on the mandrel 24 and over the split load ring 156 effectively holds the split load ring 156 together, with axial load transfer between the load sleeve 150 and the split load ring 156 being achieved via a shoulder 162 internally of the load sleeve 150.

A number of circumferentially distributed keys 164 are mounted in corresponding slots 166 in the mandrel 24, and become received into complementary slots 168 formed in the inner surface of the load sleeve 150 as the sleeve 150 is mounted onto the mandrel 24. Once assembled as such, the load sleeve 150 also becomes rotatably secured to the mandrel 24, and thus capable of resisting torque applied during connection with the connector sub 56.

In order to ensure sealing integrity, a pair of O-rings 170 is provided between the load sleeve 150 and the mandrel 24.

The load sleeve 150 may thus be absent during the process of installing the roller assemblies 78, 80, 82, and the various other components, onto the mandrel 24.

Following assembly of the various components, the load sleeve 150 may be installed, effectively permitting the construction of a more convention pin connector to be achieved.

As noted above, a lubricant circuit is provided to ensure appropriate delivery of lubricant from the lubricant reservoir to the rollers. An example of such a lubricant circuit will now be provided with reference to FIGS. 18 to 21.

Figure 18:
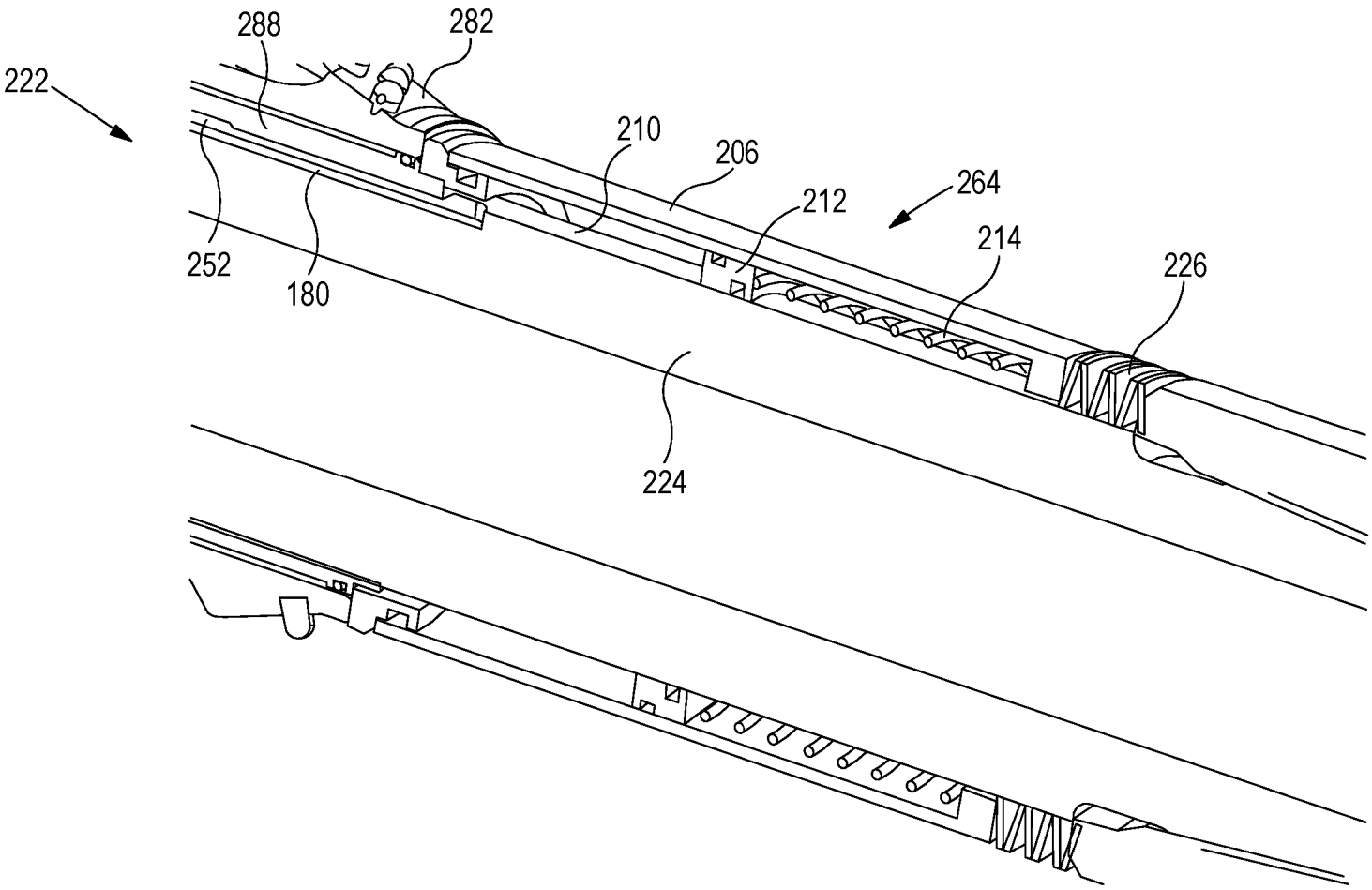
FIG. 18 is an enlarged sectional view of a lubrication system of a roller-reamer according to an example of the present disclosure.

FIG. 18 is an enlarged perspective sectional view of a portion of a wellbore roller-reamer 222, specifically in the region of a lubrication system 264 of the roller-reamer 222. In this respect the roller-reamer 222 is similar in most respects to roller-reamer 22, and as such like features share like reference numerals, incremented by 200. Due to the significant similarities a full description of all features of roller-reamer 222 will not be repeated, for brevity.

A reservoir 210 of the lubrication system 264 is provided by an annular space created between an inner surface of a reservoir sleeve 206 and an outer surface of a mandrel 224. Lubricant is communicated from the lubrication reservoir 210 to multiple roller assemblies (only one roller assembly 282 is partially shown in FIG. 18) via a communication path which will now be described.

In the present example, a spring 214 and piston 212 create a relatively low differential pressure on the lubricant within the lubrication reservoir 210 (e.g. 5 to 10 psi). This differential pressure causes lubricant to be driven from the lubrication reservoir 210 to a groove or slot 180 provided along part of the mandrel 224.

Figure 19:
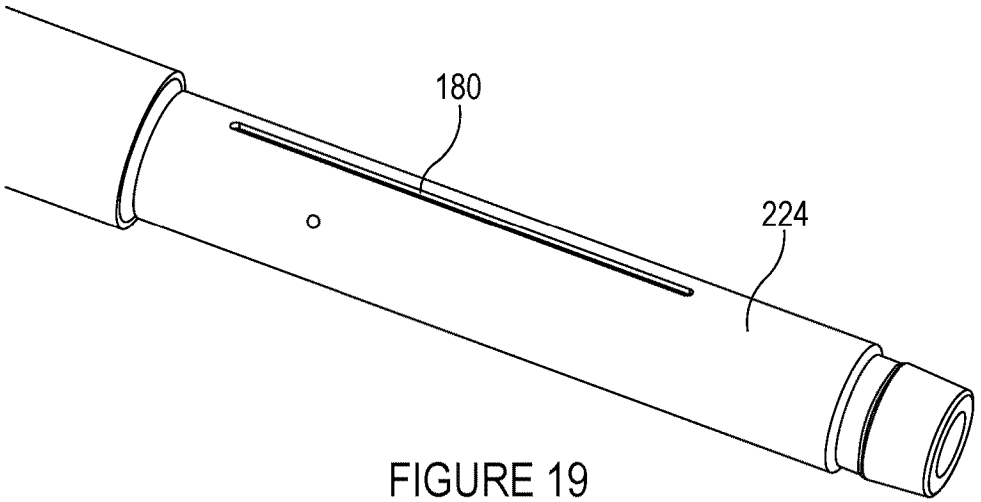
FIG. 19 is a perspective view of a mandrel forming part of the lubrication system of FIG. 18.

FIG. 19 shows the mandrel 224 in isolation, illustrating the axial direction of the groove or slot 180 along the mandrel 224. In alternative examples the groove or slot 180 may follow an alternative path, such as a helical path. The groove or slot 180 is provided in this manner to provide lubricant to all roller assemblies of the wellbore roller-reamer 222.

Figure 20:
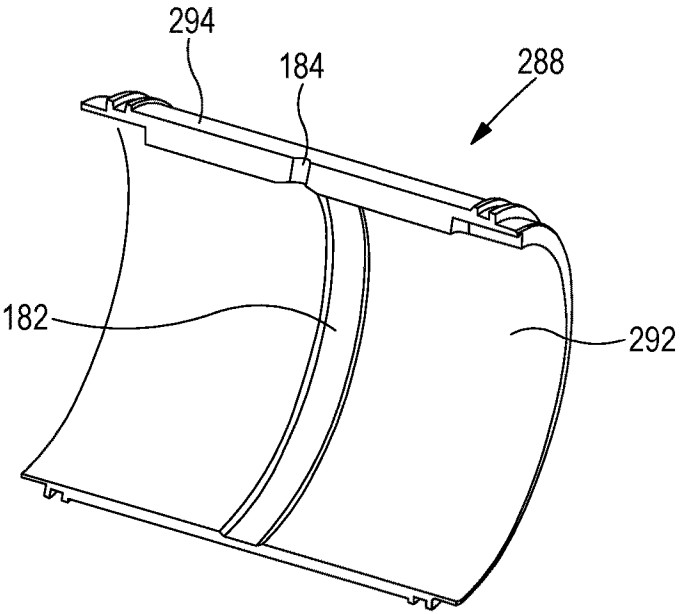
FIG. 20 is a sectional perspective view of a bearing sleeve of an individual roller assembly forming part of the lubrication system of FIG. 18.

FIG. 20 shows a perspective cross-sectional view of a bearing sleeve 288 of roller assembly 282, which defines an annular groove 182 in its internal surface 292. This annular groove 182 provides a means of communication with the lubricant groove or slot 180 of the mandrel 224.

The bearing sleeve 288 further includes a radial port 184 which provides communication between the internal annular groove 182 of the bearing sleeve 288 and an outer surface 294 of the bearing sleeve 288. Although a single radial port 184 is provided it should be understood that any number of ports may be provided. The grove or slot 180, annular groove 182 and radial port 184 thus permit lubricant to be delivered between the outer surface 294 of the bearing sleeve 288 and inner surface of the associated outer roller (not shown in FIG. 20).

Figure 21:
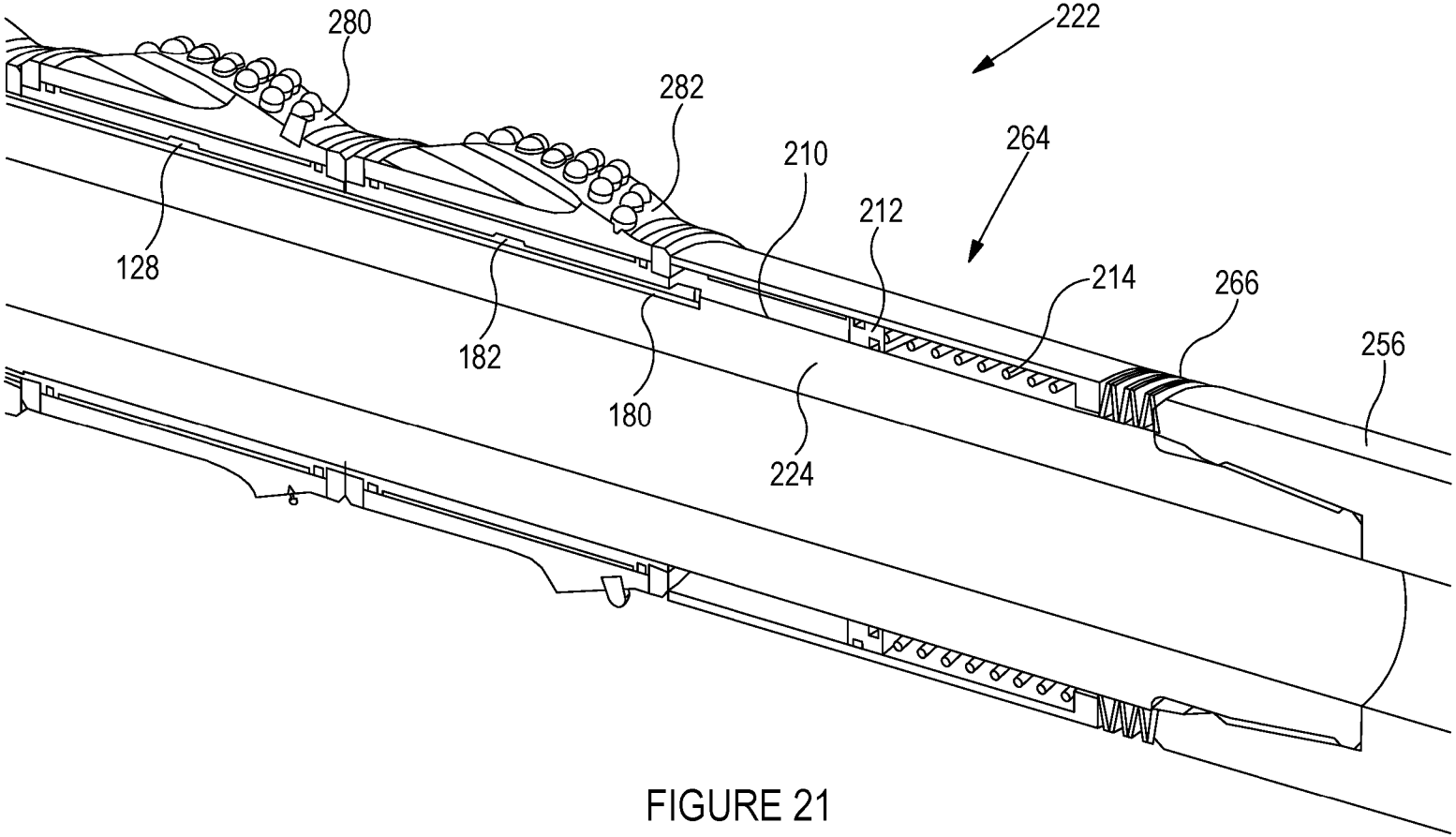
FIG. 21 an enlarged sectional perspective view of a portion of the lubrication system of FIG. 18.

FIG. 21 illustrates lubricant circuit described above delivering lubricant to multiple rollers (280, 282).

The present example roller-reamer 22 also includes a spring assembly 266 interposed between the lubrication system 264 and a connector sub 256. As before, the spring assembly 266 is energised when the connector sub 256 is coupled to the mandrel 224, thus providing an axial pre-load between different components mounted on the mandrel 224. This preload may provide sufficient pressure contact between adjacent components to retain the lubricant within the system. Alternatively, seals may be provided (such as face seals or radial seals) between the components to seal the lubricant within the system.

It should be understood that the descriptions provided here are merely exemplary of the present disclosure, and that various modifications are possible. For example, while the examples provided above include roller assemblies which include rollers mounted on respective bearing sleeves, the bearing sleeves may be omitted and the rollers mounted directly on the mandrel. Further, a single bearing sleeve may be provided to accommodate two or more rollers.

The invention claimed is:

1. A wellbore roller-reamer, comprising:

a mandrel rotatable about a mandrel axis;

a first roller mounted around the mandrel, and comprising a plurality of rib structures extending outwardly of the first roller, wherein each rib defines a discrete portion of an outer reaming surface of the first roller for engaging a wall of a wellbore, wherein each of the plurality of rib structures extend helically and continuously along the length of the first roller; the first roller being rotatable relative to the mandrel about a first roller axis which is offset from the mandrel axis such that, during use, rotation of the mandrel with the outer reaming surface engaged with the wall of the wellbore causes the first roller to be driven to rotate relative to the mandrel and ream the wall of the wellbore, wherein the rib structures are separated by respective bypass recesses, the one or more bypass recesses extending helically along the length of the first roller.

2. The wellbore roller-reamer according to claim 1, wherein the mandrel comprises two axial sections with different outer dimensions and the first roller is mounted on the axial section of the mandrel with a reduced outer dimension.

3. The wellbore roller-reamer according to claim 1, comprising a first bearing sleeve which is mounted on the mandrel, wherein the first roller is mounted on the first bearing sleeve.

4. The wellbore roller-reamer according to claim 3, wherein the first bearing sleeve defines a varying circumferential wall thickness to facilitate the first roller being mounted and arranged in such a way that the first roller axis is offset form the mandrel axis.

5. The wellbore roller-reamer according to claim 3, wherein the first bearing sleeve defines an inner cylindrical surface and an outer cylindrical surface, wherein the inner and outer cylindrical surfaces are eccentrically arranged.

6. The wellbore roller-reamer according to claim 3, comprising at least one bearing element interposed between the first roller and the first bearing sleeve, wherein the at least one bearing element extends at least one of axially, circumferentially and spirally relative to the mandrel axis.

7. The wellbore roller-reamer according to claim 1, comprising a second roller having an outer reaming surface and mounted around the mandrel, wherein the second roller is rotatable relative to the mandrel about a second roller axis which is offset from the mandrel axis such that, during use, rotation of the mandrel with the outer reaming surface of the second roller engaged with a wall of the wellbore causes the second roller to be driven to rotate relative to the mandrel and ream the wall of the wellbore.

8. The wellbore roller-reamer according to claim 7, wherein the first and second roller axes are offset relative to each other and wherein the first and second rollers are axially distributed on the mandrel.

9. The wellbore roller-reamer according to claim 7, comprising a third roller having an outer reaming surface and mounted around the mandrel, wherein the third roller is rotatable relative to the mandrel about a third roller axis which is offset from the mandrel axis such that, during use, rotation of the mandrel with the outer reaming surface of the third roller engaged with a wall of the wellbore causes the third roller to be driven to rotate relative to the mandrel and ream the wall of the wellbore.

10. The wellbore roller-reamer according to claim 9, wherein the third roller axis is offset relative to the first and/or second roller axes such that the eccentricity of the first, second and/or third rollers is provided in different radial directions relative to the mandrel, and wherein the first, second and third rollers are axially distributed on the mandrel.

11. The wellbore roller-reamer according to claim 1, comprising a lubricant system for providing a lubricant to at least the first roller, the lubricant system comprising:

a reservoir sleeve mounted around the mandrel to define a radial space between the mandrel and the reservoir sleeve, the radial space defining a lubricant reservoir; and a displacement mechanism to displace lubricant from the lubricant reservoir.

12. The wellbore roller-reamer according to claim 1, comprising an axial load mechanism to provide an axial load between components which are axially stacked on the mandrel.

13. The wellbore roller-reamer according to claim 1, wherein one end of the mandrel comprises a male threaded portion for facilitating coupling of the mandrel to a separate component the male threaded portion being provided adjacent a mounting surface of the mandrel, upon which mounting surface the first roller is mounted.

14. The wellbore roller-reamer according to claim 13, wherein the male threaded portion defines an outer diameter which permits at least the first roller to slide over said male threaded portion to allow mounting of the first roller on the mandrel.

15. The wellbore roller-reamer according to claim 13, comprising a load sleeve defining a torque shoulder, wherein the load sleeve is mountable on the mandrel and securable adjacent the male threaded portion of the first end of the mandrel, such that the torque shoulder and the male threaded portion together define a pin connector to facilitate connection with a box connector of a separate component.

16. The wellbore roller-reamer according to claim 13, wherein the load sleeve is mountable on the mandrel after at least the first roller has been mounted on the mandrel.

17. A reamer roller assembly for a wellbore roller-reamer, comprising:

a bearing sleeve defining a sleeve bore to permit mounting on a mandrel, wherein the bearing sleeve defines a sleeve bore axis; and a roller circumscribing the bearing sleeve, the roller comprising a plurality of rib structures extending outwardly of the first roller, wherein each rib defines a discrete portion of an outer reaming surface of the first roller for engaging a wall of a wellbore, wherein each of the plurality of rib structures extend helically and continuously along the length of the first roller; and wherein the roller is rotatable relative to the bearing sleeve about a roller axis, the sleeve bore axis and the roller axis being offset relative to each other;

wherein the rib structures are separated by respective bypass recesses, the one or more bypass recesses extending helically along the length of the first roller.

* * * * *